US007115073B2

(12) United States Patent
Nizamuddin

(10) Patent No.: US 7,115,073 B2
(45) **Date of Patent: *Oct. 3, 2006**

(54) EXERCISE APPARATUS FOR SIMULATING SKATING MOVEMENT

(75) Inventor: Nash Nizamuddin, Thornhill (CA)

(73) Assignee: Skatestrider Inc., Thornhill (CA)

( * ) Notice: Subject to any disclaimer, the term of this patent is extended or adjusted under 35 U.S.C. 154(b) by 204 days.

This patent is subject to a terminal disclaimer.

(21) Appl. No.: 10/873,254

(22) Filed: Jun. 23, 2004

(65) Prior Publication Data

US 2004/0241631 A1 Dec. 2, 2004

Related U.S. Application Data

(63) Continuation-in-part of application No. 09/909,020, filed on Jul. 20, 2001, now Pat. No. 6,786,850.

(60) Provisional application No. 60/237,387, filed on Oct. 4, 2000.

(30) Foreign Application Priority Data

May 7, 2004 (CA) ..... 2466543

(51) Int. Cl.
*A63B 69/00* (2006.01)
*A63B 69/18* (2006.01)

(52) U.S. Cl. ..... 482/51; 482/71; 482/79; 482/110; 482/116; 482/135; 434/253

(58) Field of Classification Search ..... 482/51–53, 482/70, 71, 79, 116, 127, 907, 11, 93, 105, 482/110, 135; 434/247, 253; 280/842
See application file for complete search history.

(56) References Cited

U.S. PATENT DOCUMENTS

| | | | | |
|---|---|---|---|---|
| 3,591,172 | A * | 7/1971 | Hude | 482/71 |
| 3,756,595 | A | 9/1973 | Hague | |
| 4,340,214 | A | 7/1982 | Schutzer | |
| 4,396,189 | A * | 8/1983 | Jenkins | 482/71 |
| 4,645,202 | A * | 2/1987 | Tomba et al. | 482/71 |
| 4,669,723 | A * | 6/1987 | Arsenian | 482/71 |
| 4,744,557 | A | 5/1988 | Smirmaul | |
| 4,781,372 | A | 11/1988 | McCormack | |
| 4,811,941 | A | 3/1989 | Elo | |
| 4,869,496 | A | 9/1989 | Colombo | |
| 4,911,430 | A | 3/1990 | Flament | |

(Continued)

FOREIGN PATENT DOCUMENTS

| | | |
|---|---|---|
| CA | 2407758 | 10/2002 |
| CH | 673092 A5 * | 2/1990 |

*Primary Examiner*—Jerome Donnelly
*Assistant Examiner*—Victor K. Hwang

(57) ABSTRACT

An exercise apparatus used to simulate skating or roller blading movement in a user includes a pair of sleds or shuttles which include a pedal adapted to support the foot of a user standing thereon. The shuttles are movable along a respective guide assembly consisting of one or more rails which curve away from each other extending from proximate forwardmost ends, outwardly and rearwardly. The rail assemblies are provided in a substantially mirror arrangement and curve downwardly from their respective forwardmost ends to a lowermost distal portion. A guide member is provided to assist in positioning and maintaining the shuttles in sliding movement along each guide assembly, whereby the reciprocal sliding movement of the shuttles along an associated guide assembly acts to guide the feet of the user in skating or roller blade movement.

39 Claims, 18 Drawing Sheets

U.S. PATENT DOCUMENTS 4,915,373 A 4/1990 Walker
5,222,928 A 6/1993 Yacullo
5,279,532 A 1/1994 Chen
5,284,460 A 2/1994 Miller et al.
5,304,106 A * 4/1994 Gresko ..... 482/53
5,328,427 A 7/1994 Sleamaker
5,391,130 A 2/1995 Green et al.
5,496,239 A * 3/1996 Kallman et al. ..... 482/71
5,503,609 A 4/1996 Bull
5,520,598 A 5/1996 Little
5,536,225 A * 7/1996 Neuberg et al. ..... 482/71
5,637,060 A 6/1997 de Souza
5,643,153 A 7/1997 Nylen et al.
5,665,033 A * 9/1997 Palmer ..... 482/71
5,692,995 A * 12/1997 Alvarez et al. ..... 482/71
5,713,794 A 2/1998 Shimojima et al.
5,718,658 A 2/1998 Miller et al.
5,855,538 A 1/1999 Argabright
5,911,650 A * 6/1999 Cox ..... 482/70
6,106,442 A * 8/2000 Tissue ..... 482/71
6,234,935 B1 5/2001 Chu
6,514,180 B1 * 2/2003 Rawls ..... 482/70
6,695,749 B1 * 2/2004 Kuo ..... 482/53
6,786,850 B1 * 9/2004 Nizamuddin ..... 482/51
7,014,595 B1 * 3/2006 Bruno ..... 482/51
2002/0145926 A1 * 10/2002 Lat ..... 482/52
2005/0014613 A1 * 1/2005 Chu ..... 482/79
2005/0079956 A1 * 4/2005 Bruno ..... 482/51
2005/0272562 A1 * 12/2005 Alessandri et al. ..... 482/52

* cited by examiner

FIG. 5
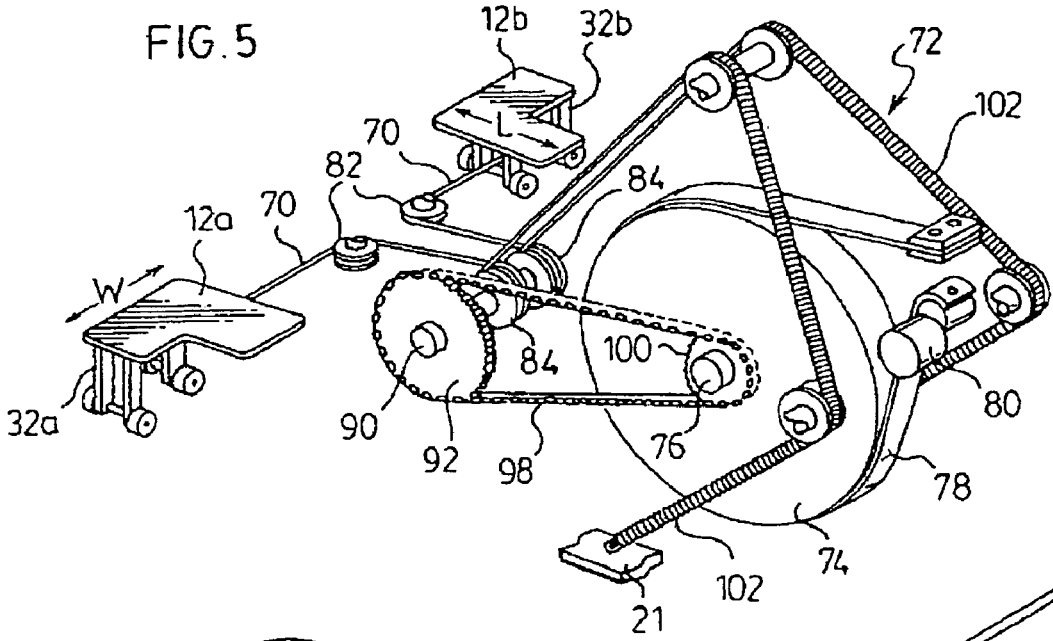
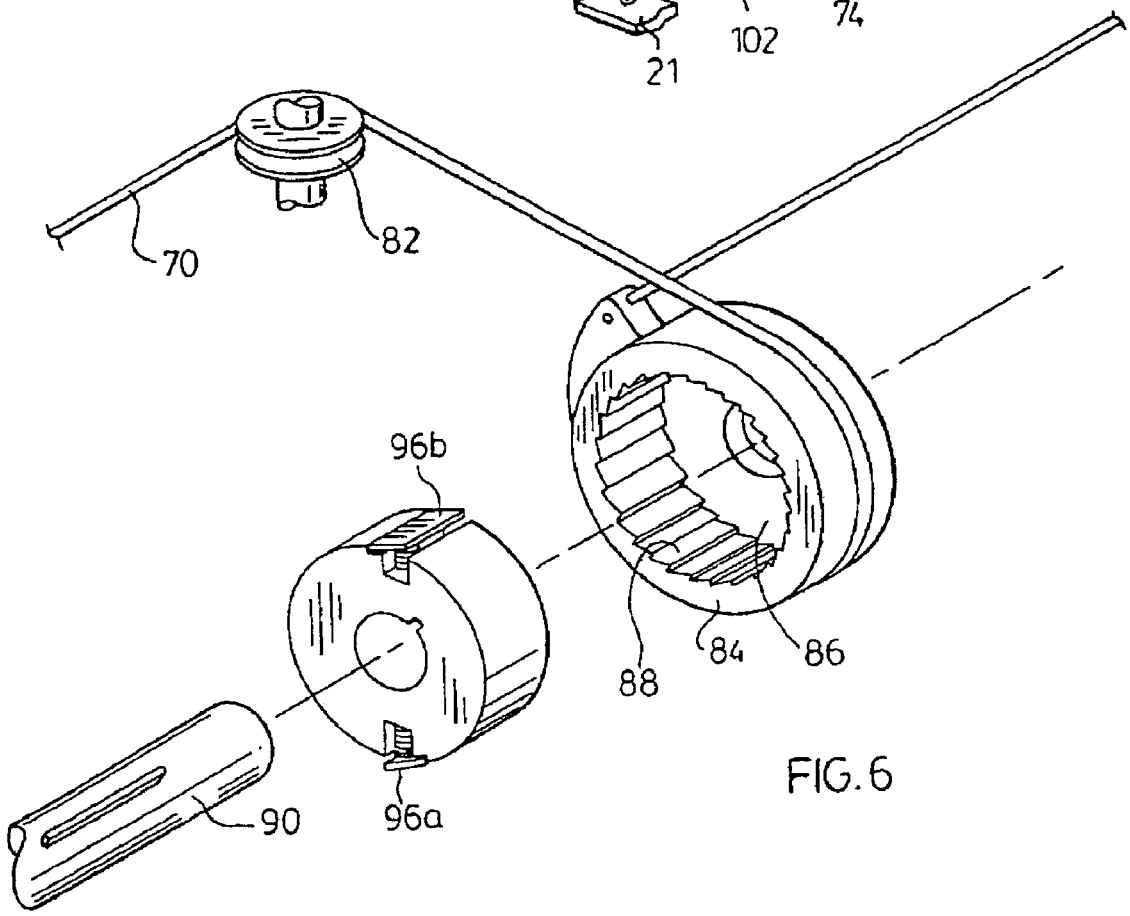
FIG. 6

FIG. 23
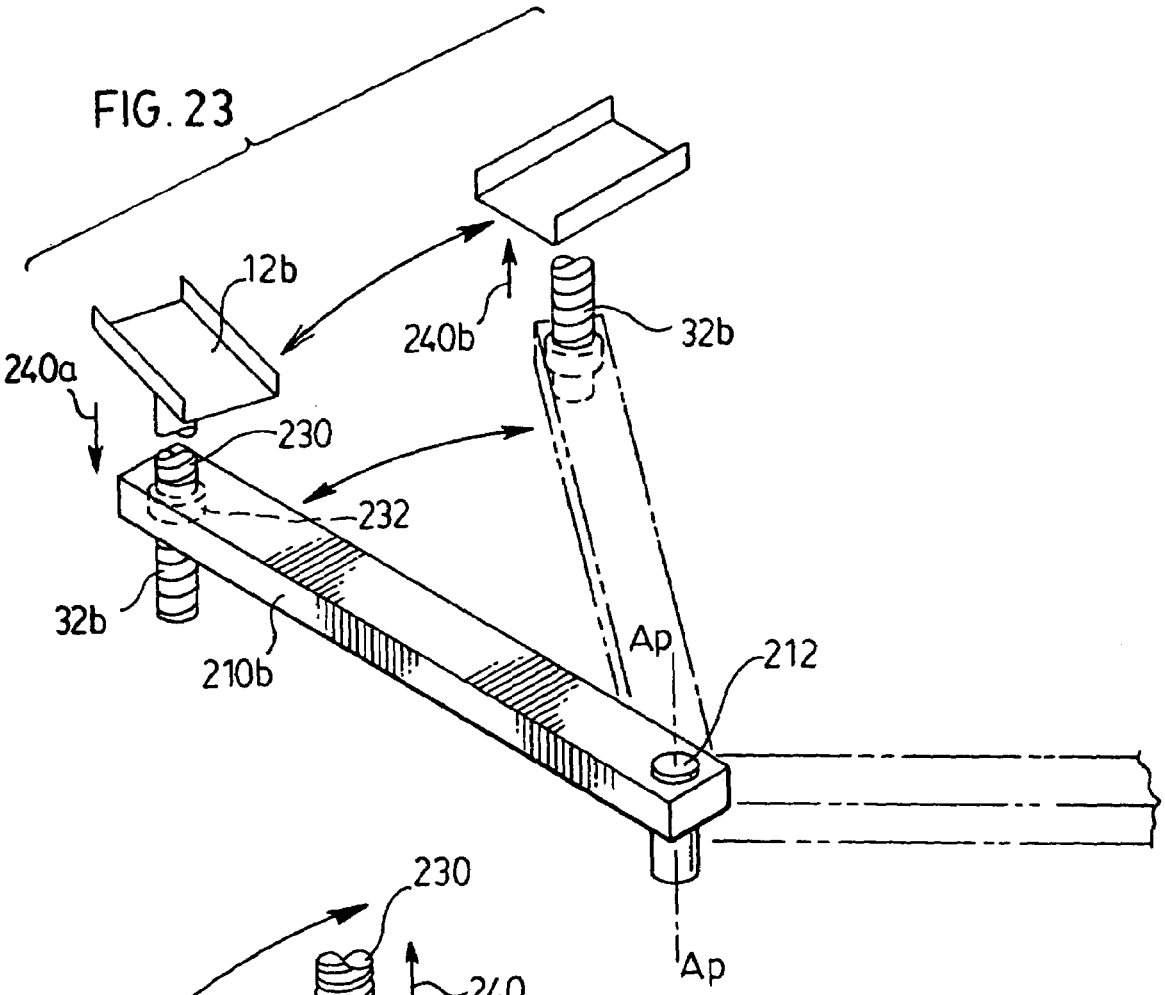
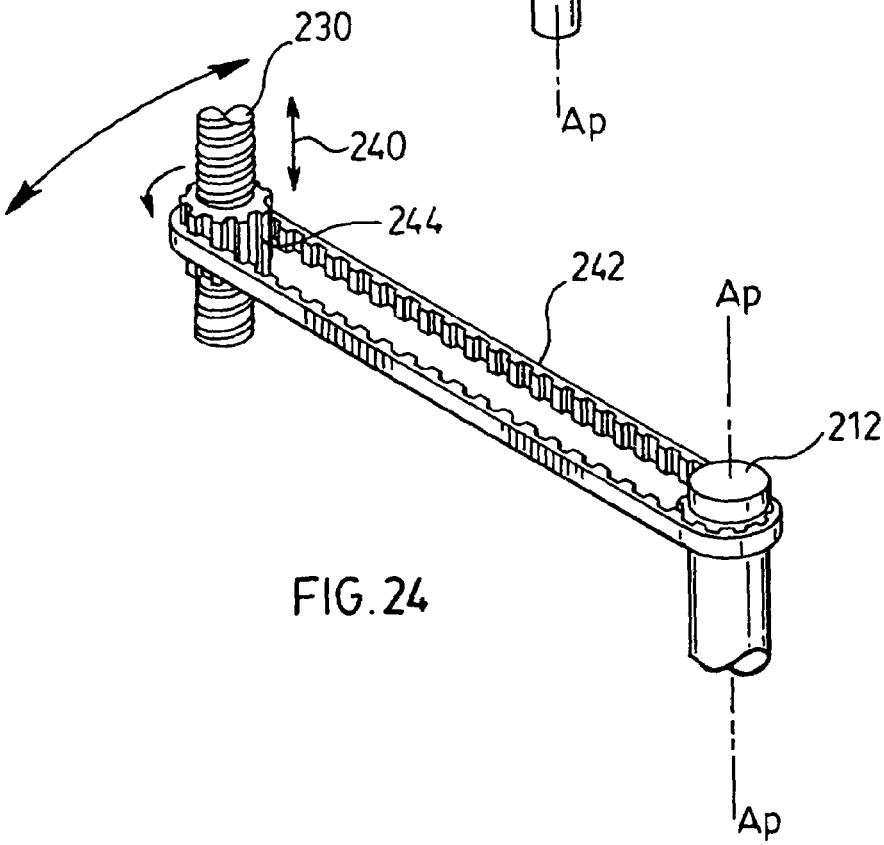
FIG. 24

FIG. 25
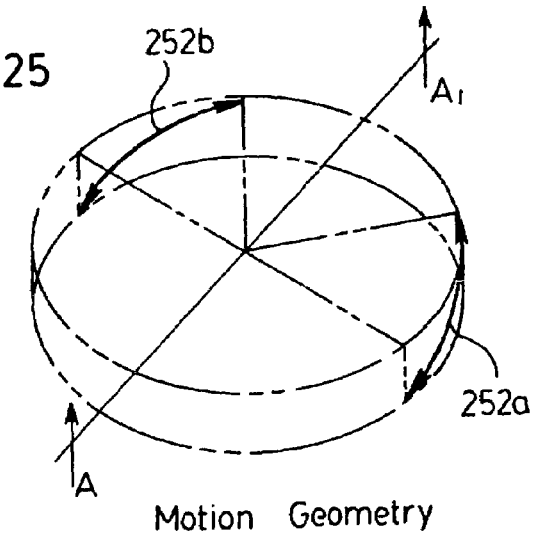
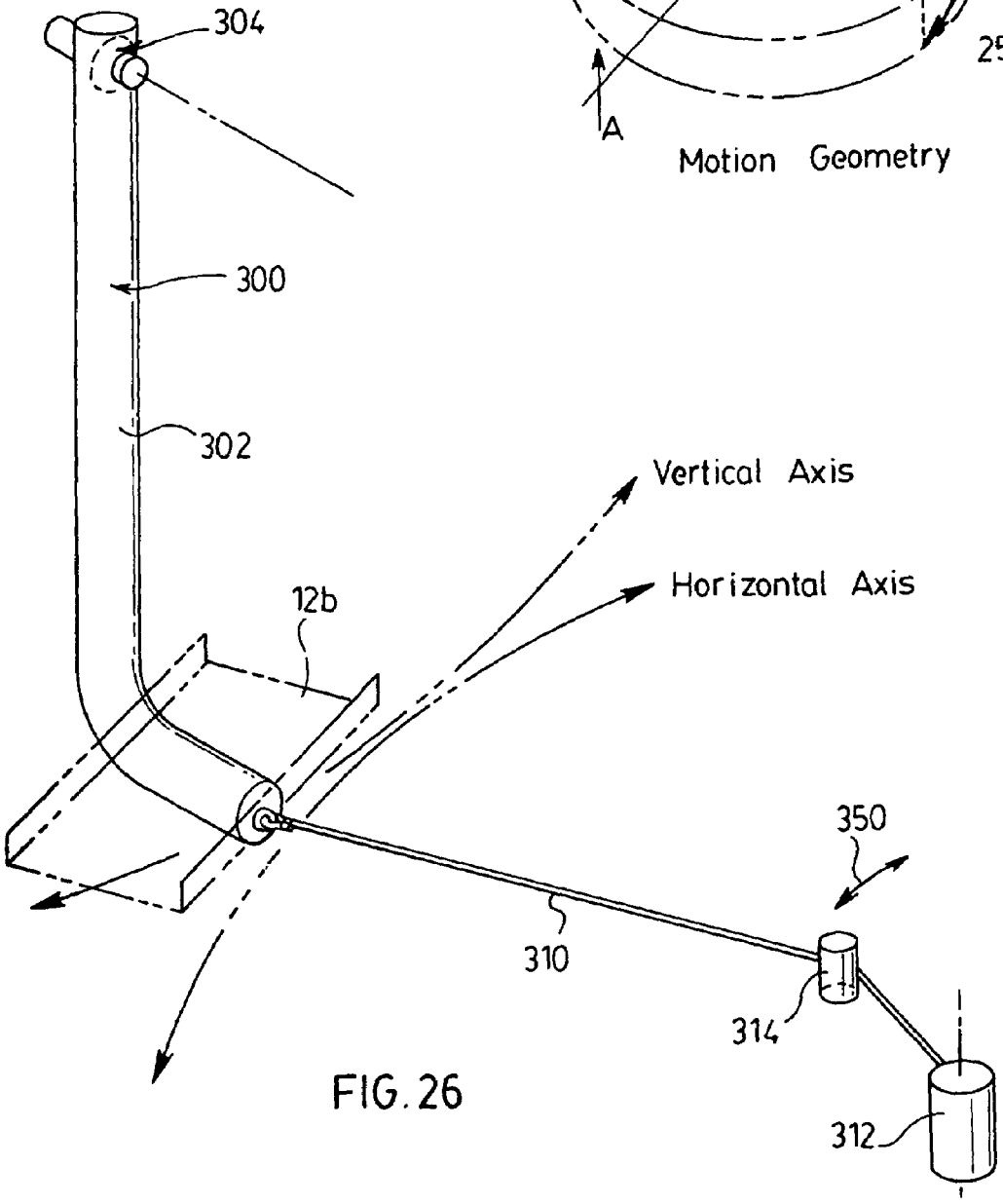
FIG. 26

EXERCISE APPARATUS FOR SIMULATING SKATING MOVEMENT

RELATED APPLICATIONS

This application is a continuation-in-part of U.S. patent application Ser. No. 09/909,020, filed Jul. 20, 2001, and entitled "Exercise Apparatus for Simulating Skating Movement", and which issued to U.S. Pat. No. 6,786,850 on Sep. 7, 2004, and which claims the benefit under 35 U.S.C. 119(e) to U.S. provisional application Ser. No. 60/237,387 filed 4 Oct. 2000.

SCOPE OF THE INVENTION

The present invention relates to an exercise apparatus, and more particularly, an apparatus which in use is adapted to simulate an athlete's natural skating or roller blading movement, whereby the user's legs travel simultaneously in a lateral and rearward motion.

BACKGROUND OF THE INVENTION

Exercise apparatus which simulate walking, running and stair climbing are well known. Running and walking exercise apparatus typically comprise an inclined moving belt or treadmill upon which the user walks or runs. Stair climbing or stepping apparatus typically include a pair of hinged pedals upon which a user stands, and in which the pedals are moved up and down by the user shifting his or her weight to simulate stair climbing movement. While conventional exercise apparatus achieve the exercise and movement of the biceps femoris muscle, they are poorly suited to provide toning and exercise the remaining leg muscles used in skating, such as abductors and adductor muscles, the gastrocnemius muscle, the soleusmuscle the gracilis muscle and/or the sartorius muscle.

In an effort to provide an exercise apparatus better adapted to exercise muscles used in skating, U.S. Pat. No. 5,718,658 to Miller et al describes a skate training apparatus which includes a pair of cantilevered support arms which are adapted to support a user's legs in lateral movement. Similarly, U.S. Pat. No. 6,234,935 to Chu describes a skating exercise machine which is adapted to simulate skating movement by the use of a pair of cantilevered supports geared so as to move in an arcuate plane. The exercise apparatus of Chu and Miller, however, suffer the disadvantage in that in their operation, the user's feet are maintained in a generally forward oriented position while moving about a lateral horizontal arc. In contrast, in roller blading or ice skating, an individual typically performs a skating stride whereby the position of each foot during each stride moves so as to turn outwardly, to provide an increased thrust force.

Heretofore, conventional skate training apparatus suffer the further disadvantage in that they are poorly suited to mimic the forward motion achieved in skating movement. In particular, as prior art skating devices are adapted to provide lateral movement substantially in a horizontal plane, conventional skating exercise apparatus fail to account for the change in leg and foot position experienced by a skater during actual forward movement. Furthermore, conventional skating exercise devices which operate to move the user's leg only in a horizontal plane as the user's leg moves outwardly, may result in increased stressing on the user's Achilles and/or fibularis tendons.

Conventional skating exercise devices suffer a further disadvantage in that their complex design makes manufacture difficult, and the cantilevered arrangement of the user supporting pedals may be susceptible to premature wear and failure.

SUMMARY OF THE INVENTION

It is an object of the present invention to provide an exercise apparatus which, in use, permits toning and exercise to a wide variety of leg muscles, including one or more of the biceps femoris muscle, the gracilis muscle, the sartorius muscle, the gastrocnemius muscle and/or the soleus muscle.

Another object of the invention is to provide exercise apparatus which is designed to simulate an athlete's natural ice skating or roller blade movement during forward motion.

Another object of the invention is to provide an exercise apparatus which in use, imparts a lateral and rearward movement to a user's legs, while producing minimal stresses on the Achilles and/or Fibularis tendons.

Another object of the invention is to provide an ice or roller blade skating simulating apparatus which, in use, is adapted to guide a user's foot reciprocally in downwardly and outward or rearwardly curving movement so as to better simulate the forward gliding motion achieved in skating.

A further object of the invention is to provide a simplified exercise apparatus which may be easily and economically manufactured, and which in use provides to a user a leg motion which approximates the motion performed by ice skating.

Another object of the invention is to provide a robust exercise apparatus which is adapted to support a user's feet in movement during a natural skating motion.

The present invention provides an exercise apparatus used to simulate skating or roller blading movement in a user. The apparatus includes a pair of pedals adapted to support the foot of a user standing thereon in simulated skating movement. Each pedal may be coupled to or provided as part of an associated shuttle, which is movable along or by one or more respective guide assemblies adapted to guide the pedals and user's feet in a downwardly and/or rearwardly curving movement.

In one embodiment, the guide assembly includes a rail assembly which includes one or more rails having rail portions which curve away from each other. Each rail portion extends from a respective proximate forwardmost end, outwardly and rearwardly. More preferably, the curved rail portion of each of the rail assemblies is provided in a substantially mirror arrangement and curve downwardly from their respective forwardmost ends so as to slope downwardly and rearwardly to a lowermost distal portion. The slope of the rail assemblies may be constant along their length, or alternately may vary in degree between the proximate and distal portions.

A guide member or mechanism may be provided to assist in positioning and/or maintaining the shuttles in sliding movement along each guide assembly. More preferably, the guide member limits movement of the shuttles in reciprocal sliding movement along an associated rail assembly so as to guide the feet of the user in skating or roller blade movement. A resistance mechanism may also be provided to enable the user to vary the resistance to which the shuttles move along the rails as, for example, to provide a workout of increased or decreased difficulty.

In another embodiment, the guide assembly used to support and/or limit the pedals in movement along a respective downward and/or rearwardly curving path includes a pair of cantilevered support or swing arms. The swing arms are coupled to either a respective individual or a single common pivot. In one possible construction, each swing arm may, for example, consist of a rigid metal or composite bar which has an elongate length selected at between about 0.5 to 1 meter. Each swing arm is positioned so that a forward end of each swing arm is movable from a forward proximal position where the swing arm extends generally forwardly from the pivot, and is rotatable in a limited arcuate movement rearwardly outwardly therefrom. A shuttle supporting an associated pedal is coupled towards the forwardmost end of each respective swing arm. Although not essential, most preferably individual pedals are pivotally secured to an associated shuttle so as to be pivotable relative to the forwardmost end of the swing arms as the swing arms are rotated about the pivot or their respective pivots. The location of the pivots towards a rearward portion of the skating apparatus and more preferably rearwardly of a user standing on the pedals in use of the apparatus, enables the pedals to be reciprocally moved along respective predetermined paths of movement which curve outwardly and rearwardly away from each other.

To achieve downward curving movement of each pedal in use of the apparatus, in one construction the swing arms are pivotally mounted in an orientation oriented so that each swing arm is inclined in the front to back orientation of the skating machine. Preferably each swing arm is mounted so as to incline upwardly in the forward direction at an inclined angle of between about 5° and 40° and more preferably about 10° and 25° when the forwardmost end of the swing arm is moved to a forwardmost position. In an alternate construction, the shuttles may be mounted to each swing arm on a helically threaded mount or post. The helical threads of the shuttle post are used to threadedly engage a complementary threaded socket formed in or coupled to the swing arm. In this construction, pivotal movement of the swing arms in use of the exercise apparatus produces relative twisting movement of the helical threads of the post and socket. This relative movement in turn vertically raises or lowers the shuttles and pedals relative to each swing arm as it pivots. Again, a resistance mechanism and/or a linkage may be provided to permit return movement of each shuttle to the forwardmost position, as the other shuttle is moved.

In another embodiment, the apparatus may include a guide assembly for guiding the pedals in a rearwardly outward and downward curving movement which includes of a pair of outwardly and rearwardly extending support arms. Most preferably, the support arms extend rearwardly and outwardly from a forward axial center position of the skating machine at a height selected between about 0.4 and 1.4 meters above the ground. A rocker arm assembly suspended from each support arm in turn is used to pivotally support an associated shuttle. The rocker arm assemblies are mounted so as to be pivotally coupled to the respective support arm so as to extend vertically therefrom. An associated shuttle used to support a pedal is in turn mounted to the lower end of each rocker arm. More preferably, the shuttles are pivotally secured to an end portion of a respective rocker arm which is remote from the associated support arm. In this construction, the pivotal movement of the rocker arm relative to the support arms results in the downwardly curving movement of the pedals along a respective predetermined path from a raised forward position, rearwardly outward to a lower distal position, such that each shuttle path curves downwardly and rearwardly outward in a mirror arrangement away from the other.

In a further embodiment, the guide assembly used to mount and guide the foot pedals and/or shuttles in rearwardly and/or downwardly curving movement could, for example, comprise a rigid support which is journaled in part about a spherical joint. In one simplified construction, the guide assembly includes a pair of J-shaped steel frame members mounted symmetrically in a mirror arrangement to each side of the machine. Each J-shaped frame member is suspended at its upper end by a spherical bearing, and mounts a respective one of the shuttles at its lower end. A tensioning wire or cable coupled to the lower end of each J-shaped member is used to restrict movement of both the lower end of each frame member and the shuttle supported thereby in arcuate movement as the frame member is moved about the spherical bearing. More preferably, the tensioning wire most preferably extends in the generally horizontal orientation and is secured at one of its ends to the lower end of the J-shaped frame member, and at its other end towards a rearward pivot point spaced towards a rearward central portion of the skating machine, and which more preferably locates substantially rearward of a user in use of the apparatus.

In an alternate possible construction, the wire may be replaced by a second rigid horizontal frame member which extends in generally the same horizontal orientation as the tensioning wire. In such a construction the horizontal frame member may be mounted at each of its ends by spherical joints. It is to be appreciated that this construction enables the end of the support member and shuttle to move along a path of movement extending from a forwardmost raised position and which curves downwardly and rearwardly to a lower position.

In one aspect, the present invention resides in a skating exercise apparatus for simulating skating or roller blading movement in a user, said apparatus including, a pair of shuttles, each of said shuttles including a frame for supporting a foot of said user standing in a generally forward facing position thereon, a pair of guide assemblies, each guide assembly supporting a respective one of said shuttles in reciprocal movement along a predetermined path, said predetermined paths extending in a direction away from the other in a generally mirror arrangement from raised proximal upper position and curving downwardly and/or rearwardly to a lower distal position, and whereby alternating reciprocal movement of said shuttles along said predetermined path moves the feet of a user thereon substantially in skating or roller blading movement.

More preferably, in said distal position said pedal is repositioned in an orientation generally transverse to said direction of said predetermined path at an angle of between about 15° and 30° relative to horizontal to position the toes of said user's foot thereon.

In another aspect, the present invention resides in an ice skating exercise apparatus comprising, a pair of shuttles, each for movably supporting a foot of a user standing in a generally forward facing position thereon, a guide assembly, said guide assembly supporting and limiting each said shuttles in movement along a respective predetermined path, said predetermined paths oriented in a substantially mirror arrangement and each extending in a direction away from the other from a generally adjacent raised proximal upper end portion and curving downwardly and rearwardly to a lower distal end portion, whereby the movement of said shuttles along said associated predetermined path substantially simulates the user's foot movement during skating.

In a further aspect, the present invention resides in an ice skating or roller blading exercise apparatus, a pair of shuttles, each of said shuttles including a frame for movably supporting a foot of a user standing in a generally forward facing position thereon, a guide assembly limiting movement of said shuttles in reciprocal movement along a respective predetermined path, each of said predetermined paths extending in a direction away from the other from a respective forward proximal end portion and curving rearwardly to a respective lower distal end portion, and whereby movement of said shuttles along said associated predetermined path moves the user's feet in simulated skating or roller blading movement.

In another aspect, the present invention resides in an exercise apparatus for simulating skating or roller blading movement in a user, said apparatus including, a pair of shuttles, each of said shuttles including a frame and for supporting a foot of said user in a generally forward facing position thereon, and a guiding mechanism, a pair of guide rail assemblies, each said guide rail assembly extending in a direction away from the other in a substantially mirror arrangement from raised proximal upper ends and curving downwardly and rearwardly to a lower distal end portion, each said guiding mechanism guiding said associated shuttle in movement along an associated one of said rail assemblies between the proximal end and distal end portion, and whereby alternating reciprocal movement of said shuttles along said associated rail assemblies moves the feet of a user thereon substantially in skating or roller blading movement.

In another aspect, the present invention resides in an ice skating exercise apparatus comprising, at least one pair of guide rails oriented in a substantially mirror arrangement and each extending from a substantially adjacent raised proximal upper end portion and curving downwardly and rearwardly to a lower distal end portion, a pair of shuttles, each for movably supporting a foot of a user thereon and including a frame and a guide assembly for retaining said shuttle in sliding movement along an associated one of said pair of rails between the proximal end portion and the distal end portion, and whereby the sliding movement of said shuttles along said associated pair of rails substantially simulates the user's foot movement during skating.

In a further aspect, the present invention resides in an ice skating or roller blading exercise apparatus, a pair of shuttles, each of said shuttles including a frame for movably supporting a foot of a user therein, and a guiding mechanism, a pair of guide rail assemblies, each said guide rail assembly extending in a direction away from the other from a respective forward proximal end and curving rearwardly to a respective lower distal end portion, each said guiding mechanism guiding said associated shuttle in movement along an associated one of said rail assemblies between the proximal end and distal end portion, and whereby movement of said shuttles along said associated rail assemblies moves the user's feet in simulated skating or roller blading movement.

In yet another aspect, the present invention resides in a method of using a skating exercise apparatus to simulate skating or roller blading movement in a user, said apparatus including, a pair of shuttles, each of said shuttles supporting a foot of said user standing thereon, a pair of guide assemblies, each guide assembly supporting and limiting an associated one of said shuttles in reciprocal movement along a respective associated predetermined path, and wherein said shuttles are movable along said associated predetermined path in a direction away from the other in a generally mirror arrangement from raised proximal upper position and curving downwardly and/or rearwardly to a lower distal position, wherein, with said user standing with each foot on an associates shuttle in a generally forward facing position, said user pushing a first said foot against said associated shuttle so as to move therewith along said associated predetermined path from said proximal upper position to said lower distal position, and thereafter pushing the second other said foot against said associated shuttle to move therewith along said associated predetermined path from said proximal upper position to said lower distal position, and whereby alternating reciprocal movement of said user's feet with said associated shuttles along said associated predetermined paths moves the feet of a user thereon in generally simulating skating or roller blading movement.

BRIEF DESCRIPTION OF THE DRAWINGS

Reference is now made to the following detailed description taken together with the accompanying drawings in which:

FIGS. 5 illustrates schematically the tensioning mechanism and cable pulley arrangement used in the exercise apparatus of FIG. 1;

FIG. 6 shows an enlarged partial exploded view of the cable pulley arrangement shown in FIG. 5;

FIG. 23 illustrates an alternate foot pedal/shuttle mounting construction for use with an apparatus in accordance with a further embodiment of the invention;

FIG. 24 illustrates a modified shuttle assembly for use with the apparatus of FIG. 23;

FIG. 25 illustrates the geometric path of movement of the foot pedals in use of the apparatus of FIG. 23;

FIG. 26 illustrates schematically an exercise apparatus in accordance with a further embodiment of the invention;

DETAILED DESCRIPTION OF THE PREFERRED EMBODIMENT

Figure 1:
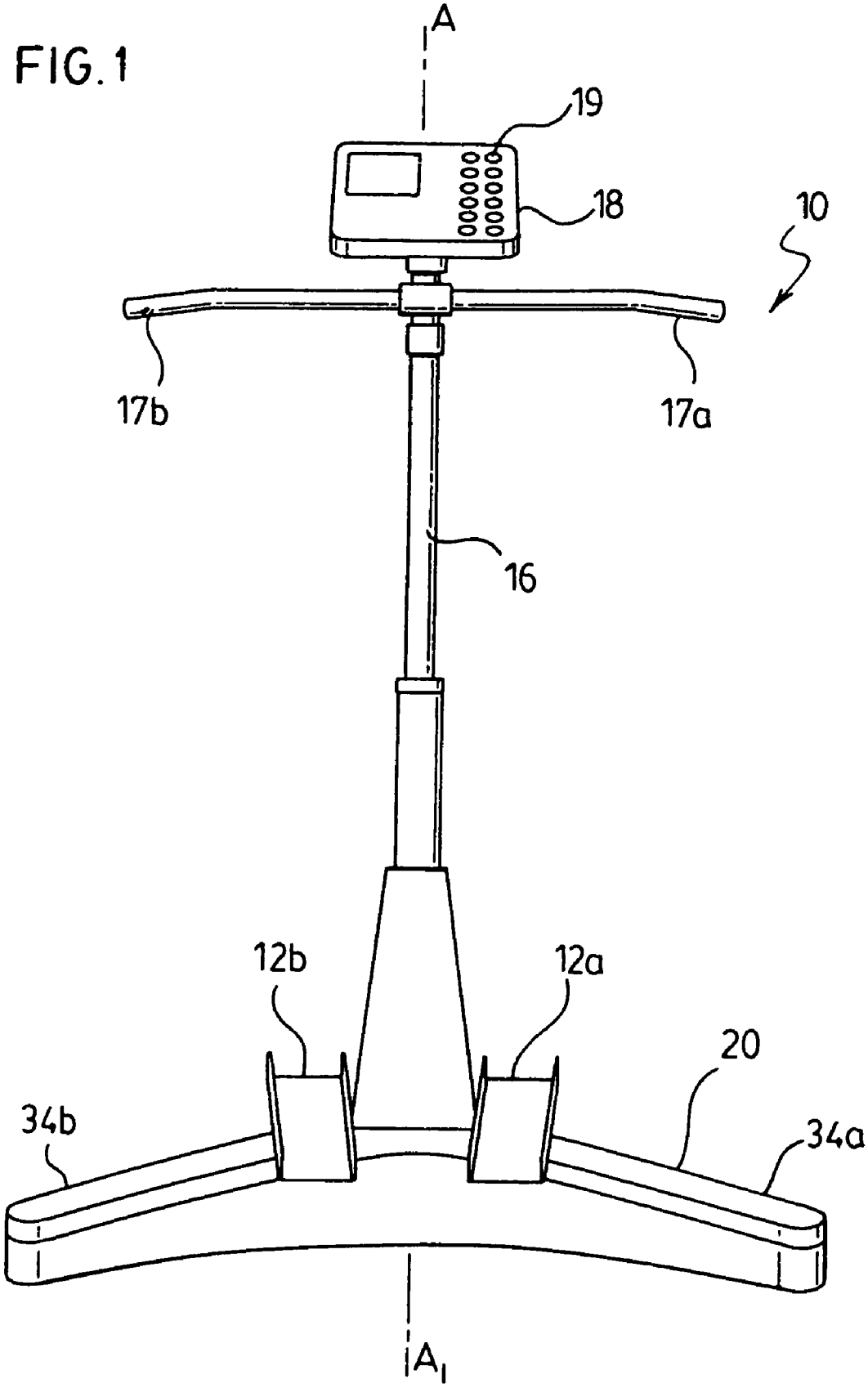
FIGS. 1 and 2 illustrate schematically an exercise apparatus in accordance with a preferred embodiment of the invention.

FIG. 1 illustrates an exercise apparatus 10 which includes a pair of movable pedals 12*a*,12*b* which, as will be described, are adapted to provide a user 8 (FIG. 2) with an exercise workout which simulates an athlete's movement when ice skating or roller blading. The apparatus 10 is shown as a free standing unit and includes a base 14, a handle assembly 16 and a microprocessor control and display 18. The microprocessor control and display 18 permits the user 8 to select from a variety of stored exercise programs which simulate skating or roller blading workout activities. The control display 18 is mounted to an uppermost end of the handle 16 and in addition to activating a selected exercise program, includes a series of controls 19 which, as will be described, provide signals to vary the tension on the pedals 12*a*,12*b* and/or select predetermined computerized exercise workouts.

FIG. 1 shows best the apparatus 10 as being substantially symmetrical about a central vertical plane $A\text{-}A_1$ and which extends in a front-to-back direction of the apparatus 10. The handle assembly 16 includes a pair of fixed laterally extending grips 17*a*,17*b* secured to an upright support adjacent to the control panel 18. The grips 17*a*,17*b* Th extend laterally outward from the central plane $A\text{-}A_1$ of the apparatus 10. It is to be appreciated that the configuration of the grips 17*a*,17*b* is selected so that they maybe comfortably grasped by the user 8 to assist in his or her balancing on the exercise apparatus 10 standing in the forward facing position shown in FIG. 2 during its use. In an alternate embodiment, a pair of movable handles (not shown) could be substituted to provide the user 8 with an upper body workout.

Figure 2:
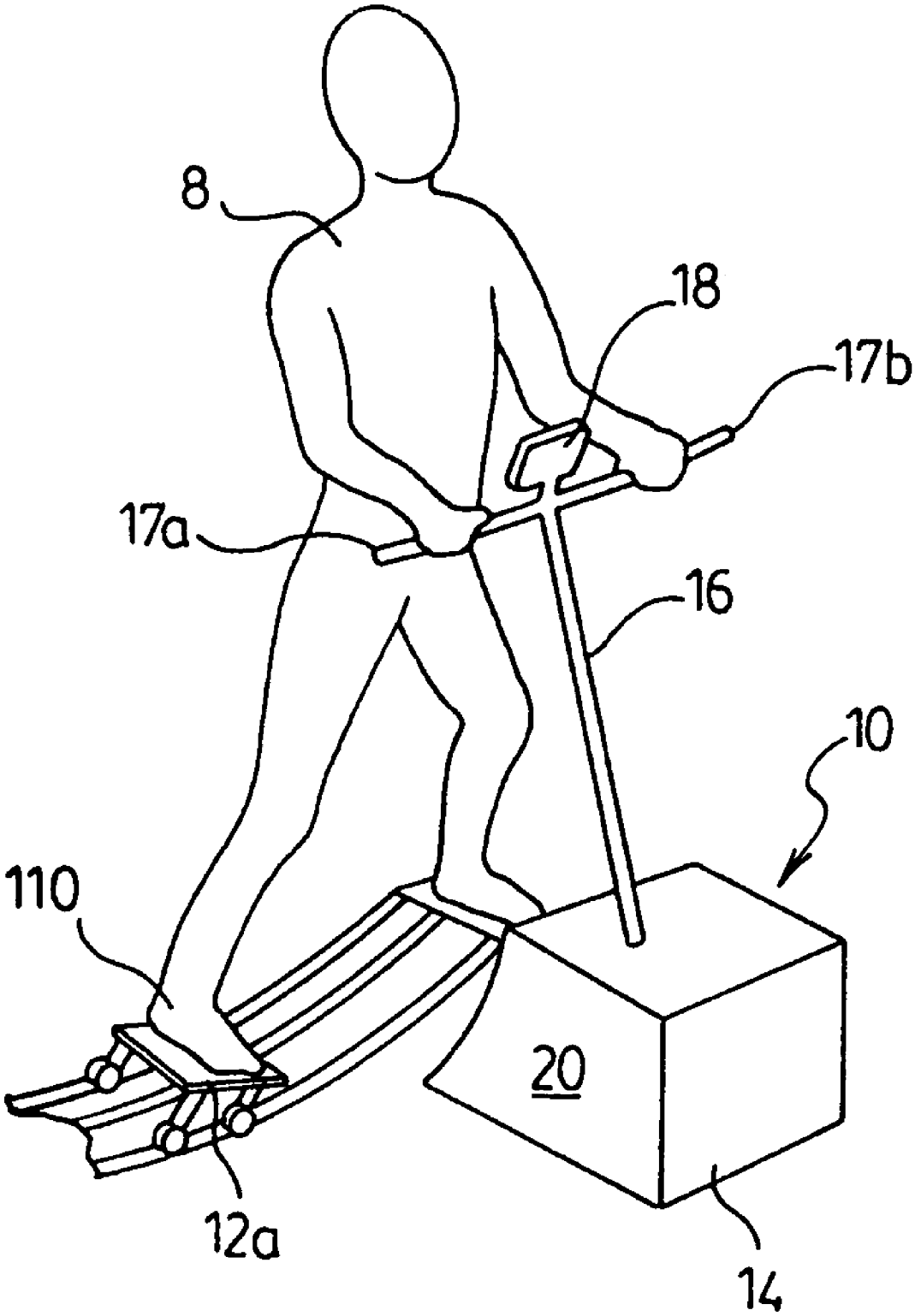
Figure 3:
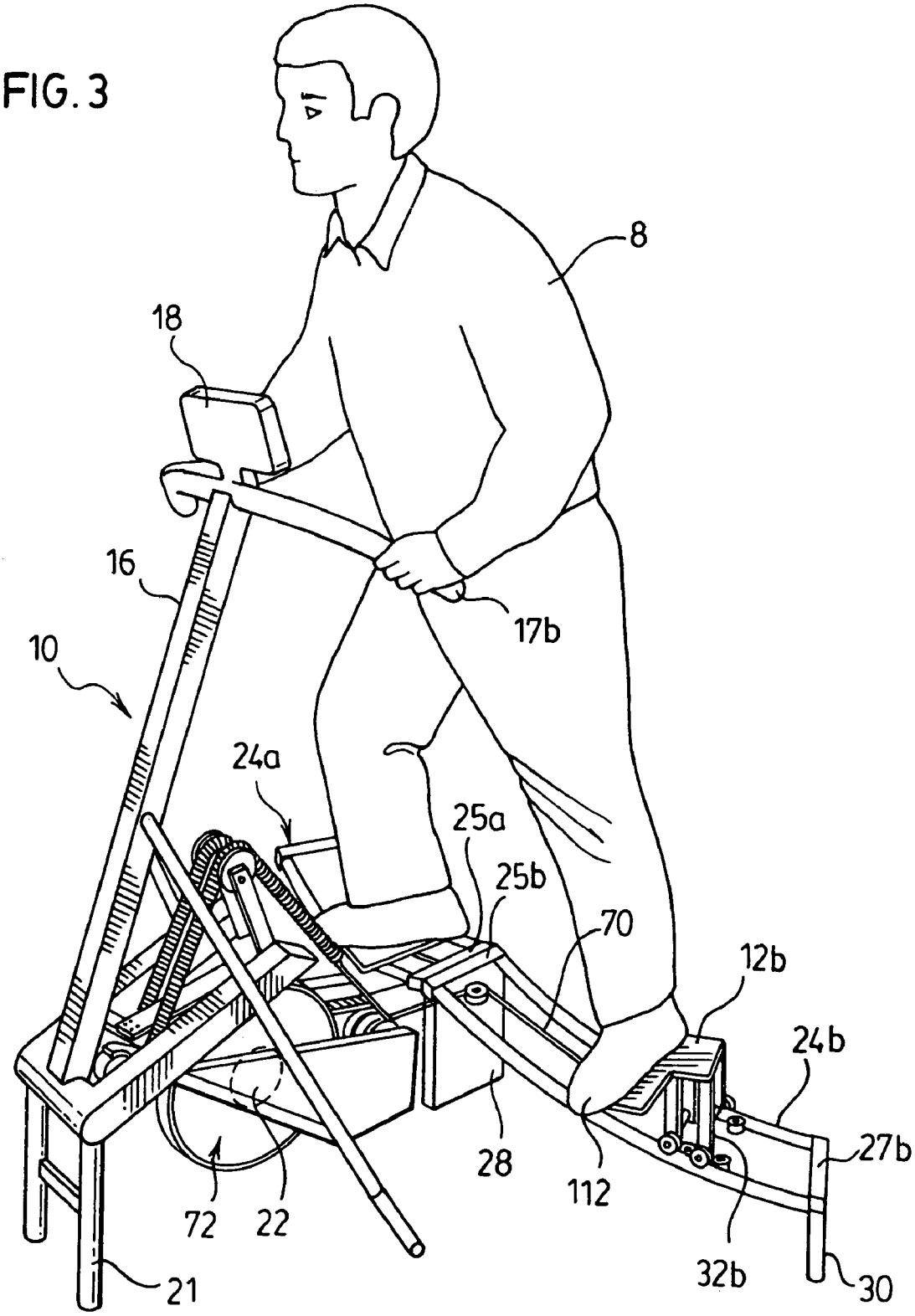
FIGS. 3 and 4 show perspective side views of the apparatus of FIG. 1 with the cowling removed and a user thereon.
Figure 4:
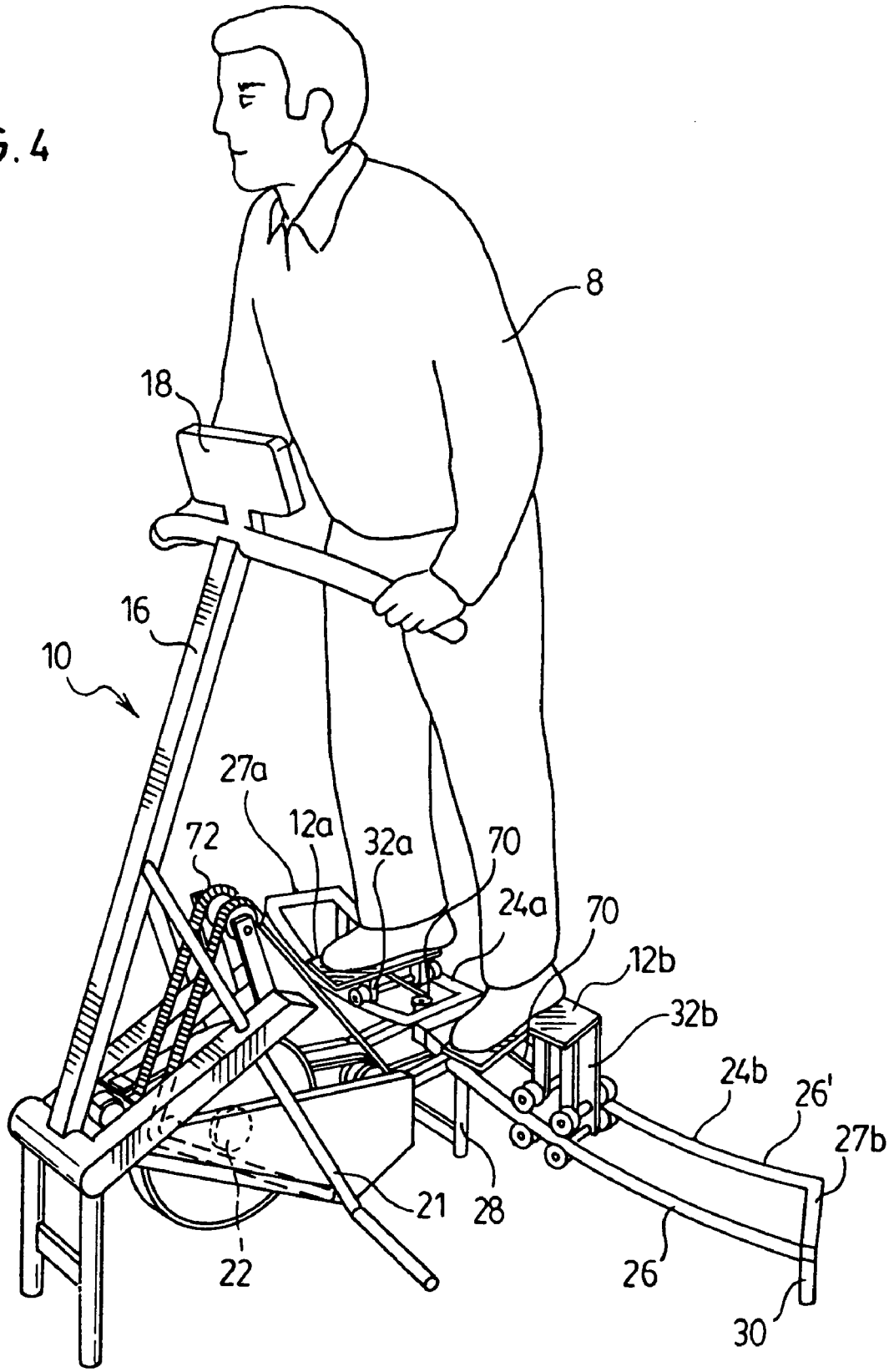

The base 14 has a size selected to provide the apparatus 10 with sufficient stability to support the user 8 standing thereon in a forward facing position in using the apparatus 10 as part of a gym or health club exercise routine. While FIGS. 1 and 2 illustrate the apparatus 10 with a covering cowling 20 in place, and which provides the apparatus 10 with a more aesthetically pleasing appearance, FIGS. 3 and 4 show best the apparatus 10 with the cowling removed for increased clarity. A tubular steel support frame 21, dynamotor 22 and two guide tracks 24*a*,24*b* are housed within the cowling 20 and form part of the base 14.

FIGS. 3, 4, 7 and 8 show the guide tracks 24*a*,24*b* best as each including a pair of parallel spaced, tubular steel rails 26,26'. The rails 26,26' are bent such that each guide track 24*a*,24*b* curves outwardly and rearwardly from respective adjacent proximal ends 25*a*,25*b* to a distal end 27*a*,27*b*. Each of the pairs of rails 26,26' is joined and supported at the proximal inner ends 25*a*,25*b* of each track 24*a*,24*b* by a steel inner vertical support 28, and at their distal ends 27*a*,27*b* by a steel outer vertical support 30. The height of the supports 28 are most preferably selected greater than that of the vertical support 30 such that the guide tacks 24*a*,24*b* each slope downwardly from their proximal ends 25*a*,25*b* towards the distal ends 18*a*,18*b*. Most preferably, the guide tracks 24*a*,24*b* have the identical mirror construction and extend from the mid-plane $A\text{-}A_1$ (FIG. 1) of the apparatus 10, curving outwardly therefrom and extending rearwardly downward in opposing directions to the respective distal ends 27*a*,27*b*. As seen best in FIG. 8, although not essential, most preferably the degree of downward curvature of the tracks 24*a*,24*b* gradually decreases in the direction away from the plane $A\text{-}A_1$.

The pedals 12*a*,12*b* are formed as a flat metal plate sized to support, respectively, the right and left feet of the user 8. The pedals 12*a*,12*b* are shown best in FIGS. 4 and 7 as being coupled to a respective shuttle 32*a*,32*b*, and which are each movable along an associated guide track 24*a*,24*b* to provide the user 8 with the desired movement. The pedals 12*a*,12*b* are mounted so as to extend upwardly through a corresponding slit 34*a*,34*b* (FIG. 1) formed in the cowling 20. It is to be appreciated that the slits 34*a*,34*b* have a curvature corresponding to that of the tracks 24*a*,24*b*, so as to permit the substantially unhindered movement of the shuttles 32*a*, 32*b* along each associated track 24*a*,24*b*. Although not essential, straps (not shown) may optionally be provided to assist in maintaining the user's 8 feet in the desired position on the pedals 12*a*,12*b*.

Figure 7:
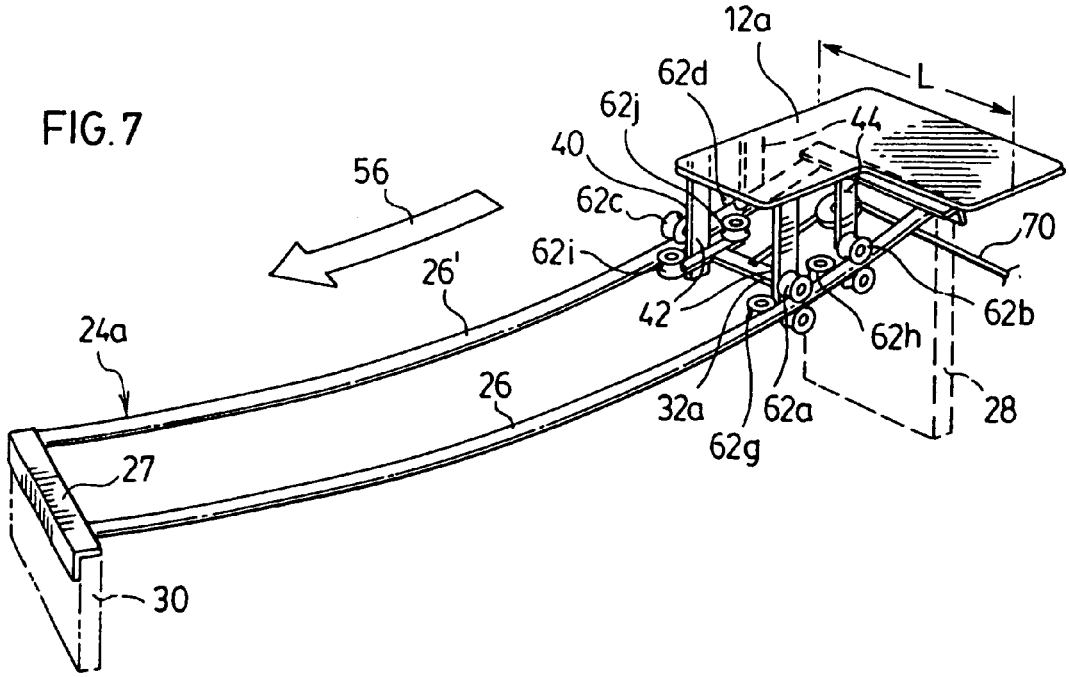
FIG. 7 shows a partial perspective view of the right side of the shuttle and rail assembly of FIG. 3.
Figure 8:
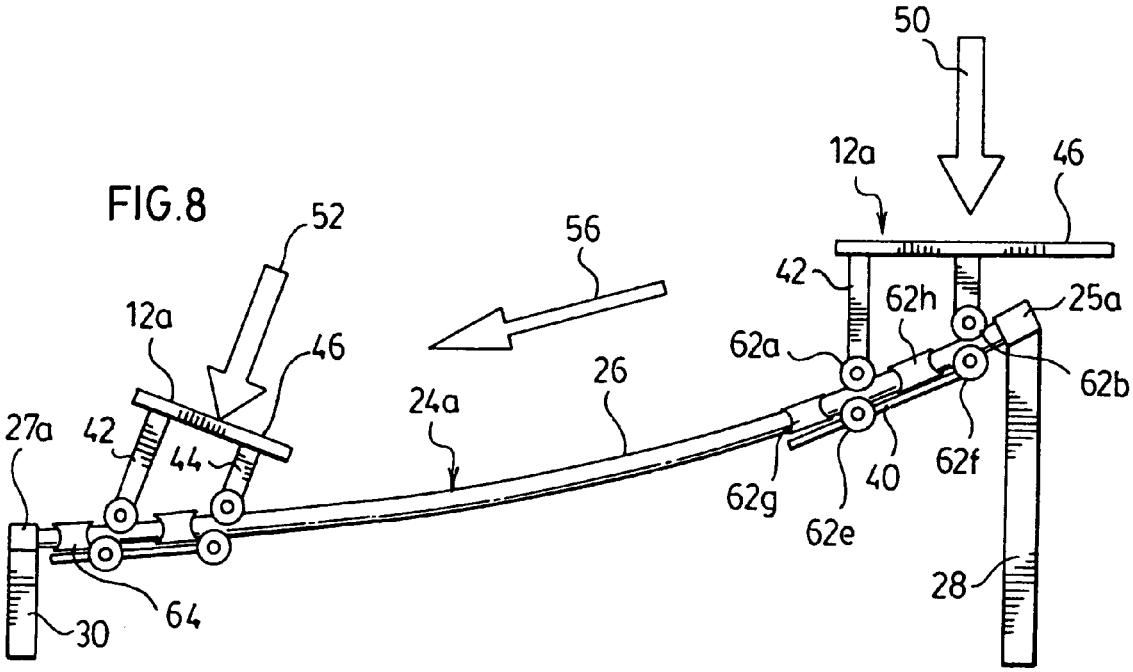
FIG. 8 shows a schematic side view of the shuttle and rail assembly of FIG. 7.

FIGS. 7 and 8 show best the construction of the shuttle 32*a*, the shuttle 32*b* having the identical construction. The shuttles 32 include a metal frame 40 which spans across the respective pair of rails 26,26' forming each track 24*a*,24*b*. The frame 40 includes a pair of distal-most vertical pedal support members 42 which are oriented closest to the distal ends 27*a*,27*b* of the tracks 24*a*,24*b*, respectively, and a pair of proximal-most vertical pedal support members 44 which are spaced closest to the proximal track ends 25*a*,25*b*. As shown best in FIG. 8, the members 42 have a vertical height selected greater than that of the member 44. Most preferably, the height of the members 42 is chosen relative to that of the members 44 such that the pedal 12 supported thereby assumes an orientation with its planar upper surface 46 (FIG. 8) positioned in an orientation inclined at between about 0 and about ±15° relative to the horizontal when the shuttles 32 are moved along the associated tracks 24 to a position substantially adjacent to the proximal end 25 shown by arrow 50. Furthermore, as the shuttles 32 move adjacent to the distal end 27 of each associated guide track 24 to the position shown by arrow 52, the increased height of the pedal support members 42 results in the pedal 12 tilting forwardly so that its upper surface 46 assumes an orientation inclined at between about 15 and 50°, and more preferably about 30°.

It is to be further appreciated that as the frame 40 moves along its associated guide track 24 towards the distal end 27 in the direction of arrow 56, the orientation of the pedals 12*a*,12*b* rotate with the curvature of the rails 26,26', moving from a generally forward orientation when the shuttle 32*a*, 32*b* coupled thereto is spaced adjacent to the proximal end 25, and a position rotated therefrom in a general outward facing orientation when the shuttles 32 are moved to the track distal ends 27.

FIGS. 7 and 8 show best each shuttle 32 as including a number of guide wheels identified generally as 62. The guide wheels 62 are rotatably secured to the frame 40 for rolling movement along the associated guide track 24. Most preferably, the shuttle 32 includes two pairs of load bearing guide wheels 62*a,b* and 62*c,d* (FIG. 7) which engage and roll along an uppermost surface of the associated guide rails 26,26', respectively. One and preferably at least a pair of guide wheels 62*e*,62*f* (FIG. 8) are positioned beneath a corresponding load bearing wheel 62*a*,62*b* of the shuttle 32. The wheels 62*e*,62*f* are located in a position engaging an underside of the guide rail 26 to prevent the shuttle 32 from being raised therefrom. Similarly, pairs of horizontal locating guide wheels 62*g*,62*h*,62*i*,62*j* (FIG. 7) engage the inside facing surfaces of the respective rails 26,26' to prevent the lateral movement of the shuttle 32 from the track 24 and maintain its correct orientation thereon. Although not essential, the guide wheels 62 are most preferably provided with a generally concave peripheral surface 64 (FIG. 8), having an internal curvature corresponding to the circumferential curvature of each tubular rail 26,26'.

Most preferably, each of the shuttles 32*a*,32*b* are independently movable relative to each other against the tension of a return cable 70 (FIG. 3). As shown best in FIGS. 3 to 6, the tensioning cables 70 consist of flexible steel aircraft cable coupled to a tensioning mechanism 72 operating in conjunction with the dynamotor 22. The tensioning mechanism 72 is shown best in FIG. 5 as including a fly wheel 74 which is rotatable about an axle 76, a tensioning strap 78, which is provided in contact with a circumferential periphery of the fly wheel 74, and a caming motor 80. The caming motor 80 is powered by the dynamotor 22 and operates in response to signals received from the controller 18. Through the controller 18, the motor 80 is operated to selectively increase or decrease the friction contact between the tensioning strap 78 and the fly wheel 74, to produce a corresponding increase or decrease in the apparatus resistance.

As shown best in FIGS. 5 and 6, each of the tensioning cables 70 are secured at one end to a respective shuttle frame 40 extending about a pulley 82 and being wound about the periphery of an associated cylindrical spool ratchet 84*a*,84*b*. The spool ratchets 84 are each provided with a through opening 86 defined by a radially extending rack 88. The spool ratchets 84*a*,84*b* are journaled for rotation in one common direction about a chain drive axle 90 which has secured at its end a toothed sprocket 92. As shown in FIG. 6, a one-way rotary bushing 94 is secured to the chain drive axle 90 for selective engagement with the rack 88 of each spool 84. The rotary bushings 94 are each provided with a pair of radially opposed spring biased cams 96*a*,96*b* which are adapted to engage the teeth of the rack 88 only in the forward movement of the axle 90 for rotation therewith, while permitting the ratchet spools 84 to rotate relative thereto on return movement in the opposite direction. A drive chain 98 extends about the tooth sprocket 92 and a drive sprocket 100 coupled to the fly wheel axle 76, whereby rotation of the axle 90 and sprocket 92 acts to rotate the fly wheel 74 and provide power to the dynamotor 22.

A pair of elastomeric return cords or shock cords 102 are shown in FIG. 5 as being secured at one end to the apparatus frame 21, and at their other end to an outer periphery of an associated spool ratchet 84. It is to be appreciated that the resiliency of the elastomeric cords 102 act to pull the spool ratchet 84 to a fully returned position, whereby the return cable 70 is wound fully about the periphery of the ratchet 84, resulting in the shuttle 32 coupled thereto moving to a start position adjacent the axis $A\text{-}A_1$.

In operation, the user 8 stands on the apparatus 10 grasping the handle grips 17*a*,17*b* with his feet facing forward and resting on the pedals 12*a*,12*b* in the manner shown in FIG. 2. The controller 18 is then activated by the user 8 to select a preprogrammed workout stored therein, whereby the controller 18 will provide a set of program signals to the motor 80 to adjust the pressure applied to the flywheel 74 by the tensioning strap 78.

To initiate the exercise workout, the user 8 pushes outwardly and rearwardly with the right foot 110 (FIG. 2) on the right pedal 12a to start skating movement. As the user's foot 110 moves away from the plane $A\text{-}A_1$, the shuttle 32*a* travels along the track 24*a* towards its distal end 27*a*. As the pedal 12*a* moves away from the start position adjacent the plane $A\text{-}A_1$, its upper surface 46 begins to tilt along its lateral width W (FIG. 5) forwardly in the direction of the rail 27, pivoting about a horizontal axis, as it travels towards the distal end 27*a* of the tack 24*a*. Furthermore, as the shuttles 32*a*,32*b* each travel along the respective tacks 24*a*,24*b*, the pedals 12*a*,12*b* rotate with the curvature of the rails 26,26'. As a result, the user's leg is rotated so that the toes of the user are oriented to face outwardly in a position generally transverse to both the tack 24*a*,24*b* length and path of shuttle 32*a*,32*b* movement as each leg is extended rearwardly. Although not essential, more preferably as the user's leg is rotated and extended, the pedals 12*a*,12*b* are repositioned with their longitudinal length L (FIG. 1) oriented generally transverse to the path of shuttle movement. More preferably, as each pedal 12*a*,12*b* moves rearwardly to the distal ends 27*a*,27*b*, the upper surfaces of the pedals 12*a*,12*b* incline downward along their As the shuttle 32*a* moves towards the distal end 27*a* of the track 24*a*, the tensioning cable 70 unwinds from the spool 84 and imparts a rotational force on the spool ratchet 84. In addition to stretching and causing the return cord 102 to wind about the spool ratchet 84, the movement of the spool ratchet 84 results in the engagement of the rack 88 with the cams 96 on the periphery of the rotary bushing 94. The engagement between the cams 96 and rack 88 causes the bushing 94 and axle 90 to rotate with the spool 84 producing a corresponding rotation in the sprocket 92, drive chain 98 and flywheel drive sprocket 100 against the friction of the tensioning strap 78. The rotation of the drive chain 98 operates to rotate the fly wheel 74 about the axle 76 providing additional power to the controlling dynamotor 22.

Following movement of the pedal 12*a* to the distal end 27*a* of track 24*a*, the user 8 shifts his weight onto the left foot 112 (FIG. 3) to move the pedal 12*b* along the track 24*b* towards the distal end 27*b*. It is to be appreciated that the pedal 12*b* travels along the track 24 in the minor manner to that of pedal 12*a*.

Furthermore, as the user 8 shifts his weight onto pedal 12*b*, the return cable 70 which is coupled to the shuttle 32*a* is wound about spool ratchet 84 associated therewith by the return elasticity of the cord 102. The winding of the cable 70 about the spool 84 draws the shuttle 32*a* in return movement along the track 24*a* to the start position adjacent to the axis $A\text{-}A_1$ and proximal end 25*a*. As indicated, with the return movement of the elastomeric cord 102 and the rewinding of the cable 70 about the spool ratchet 84, the ratchet 84 rotates relative to the rotary bushing 94 without the engagement of cams 96 with the rack 88. In this manner, the axle 90 and drive sprocket 100 are driven in only one direction of rotation by the successive engagement of the spool ratchet 84 which is coupled to the return cable 70 secured to each of the two shuttles 32*a*,32*b*.

The skating motion is thus simulated by the apparatus 10 with the user sequentially shifting his or her weight between the pedals 12*a*,12*b*. In addition to more closely simulating a true skating motion, the rotational movement of the pedals 12*a*,12*b* as they move along the guide tracks 24*a*,24*b* optimizes the exercise of the user's 12 leg muscle groups, as the user shifts his weight between the pedals 12*a*,12*b*.

Optionally, the apparatus 10 could be provided with a motorized lift (not shown) which could be selectively activated to raise or lower the proximal ends 25*a*,25*b* of the tracks 24*a*, 24*b* at the plane A-$A_1$ relative to their distal end providing a more varied workout. Similarly, the control display 18 could be used to alter the length of maximum movement of the shuttles 32*a*,32*b* along the tracks 24*a*,24*b* to simulate different stride lengths and/or provide either variable or constant tension to the cables 70 as the shuttles 32*a*,32*b* are moved.

Figure 9:
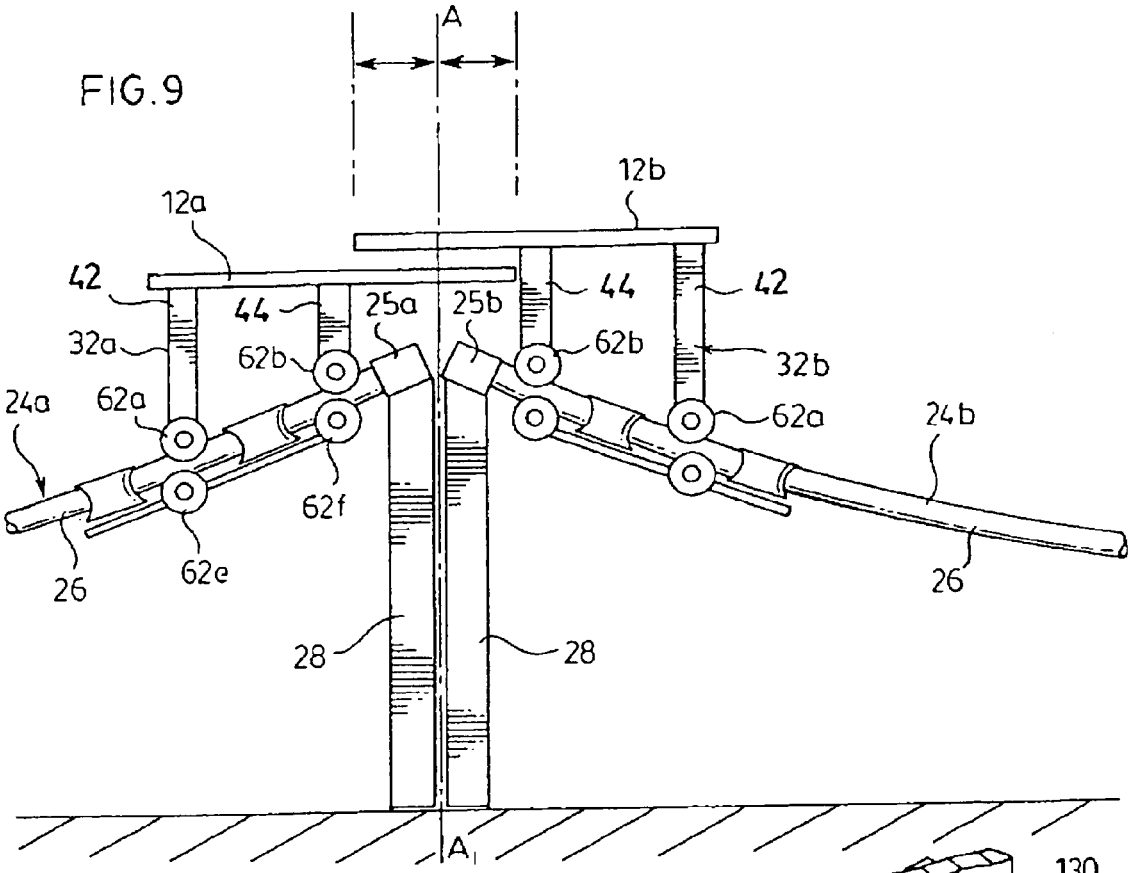
FIG. 9 illustrates schematically a partial front view of the shuttle and rail assembly for use with the apparatus of FIG. 1 in accordance with a second embodiment of the invention.

FIG. 9 shows an alternate possible sled and pedal construction in accordance with a second embodiment of the invention and wherein like reference numerals are used to identify like components. In FIG. 9, the pedals 12*a*,12*b* are mounted to the respective shuttles 32*a*,32*b* in a cantilevered arrangement. In particular, the pedals 12*a*,12*b* are positioned so as to extend inwardly towards each other over the proximal-most shuttle supports 44. It is believed that the pedal and shuttle configuration of FIG. 9 is advantageous in that it permits the full return of the pedals 12*a*,12*b* to a position substantially aligned with the plane A-$A_1$. This configuration would advantageously simulate most closely, true skating movement where on skating in forward movement, a user's foot orients directly over the individuals center of mass.

Figure 10:
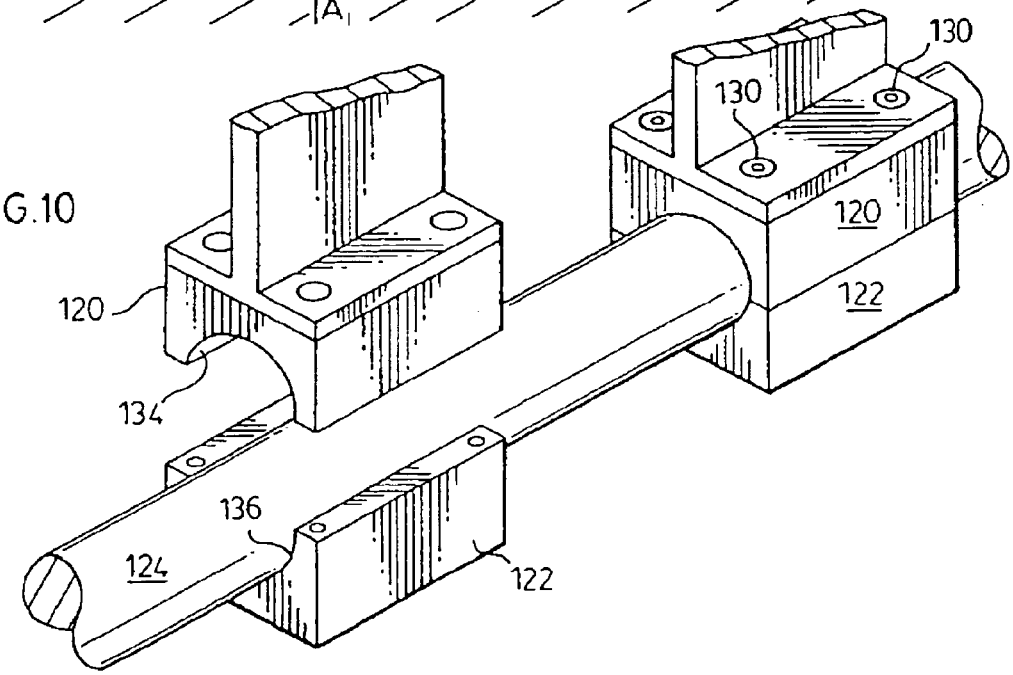
FIG. 10 illustrates an enlarged schematic view of a guide mechanism used in securing a shuttle to a guide rail assembly in accordance with a further embodiment of the invention.

Although the preferred embodiment illustrates the pedals 12*a*,12*b* as being mounted to a wheeled shuttle 32 or trolley which travels along pairs of tubular guide rails 26,26' the invention is not so limited and other assemblies for guiding movement of the pedals in outwardly rearward and/or downward curving movement may also be used. Similarly, although the detailed description describes the guiding mechanism used to maintain each shuttle 32*a*,32*b* on its associated rail assembly 24*a*,24*b* as comprising a series of spaced guide wheels 62, other guide assemblies including, without restriction, the use of dovetail slide bearings, ball bearings, or the like, could also be used without departing from the spirit and scope of the invention. Other shuttle arrangements and guide configurations are also possible and will now become apparent. Reference may be had to FIG. 10 which illustrates one possible alternate shuttle guide assembly. In FIG. 10, two pairs of slide bushings 120,122 are provided in place of the offset wheel construction shown in FIG. 3. The slide bushings 120,122 are adapted to engage a single tubular steel rail 124 in longitudinal sliding movement therealong. The bushings 120,122 are secured to each other by a series of threaded screws 130 and are further provided with a curved slide surface 134,136, respectively, having a profile selected complementary to the radius of curvature of the rail 124.

While FIG. 3 illustrates the use of cables 70 to provide independent return movement of the shuttles 32, the invention is not so limited. Chains or belts could be substituted for the cables 70 with adjustments made to the pulley arrangement. In a more economical construction, the shuttles 32 could be connected to each other for dependent movement, or alternately, the use of cables to provide return movement could be omitted in their entirety.

While the preferred embodiment of the invention discloses the tensioning mechanism as comprising a flywheel 74 and adjustable tensioning strap 78, it is to be appreciated that other tensioning devices could also be used, including without restriction, weights or pressure stacks, fan resistant mechanisms and electromagnetic resistance mechanisms.

Although the detailed description of the invention describes the shuttle frame 40 as configured to incline in a forward direction as the shuttles 32 move rearwardly along the tracks 24, the invention is not so limited. The shuttles 32 could include a platform which is maintained at a relatively constant angle relative to the horizontal as the shuttle 32 moves. Alternate shuttle frame configurations could also be used.

Similarly, while the use of elastomeric shock or bungee cords 102 are described as assisting in the return movement of the shuttles 32 and pedals 12 to the initial starting position, the shock cords 102 could be omitted in their entirety and the shuttles 32 moved in return movement through the exertions of the user 8 alone. Alternately, other return mechanisms, including, without limitation, resiliently extendable springs, could also be employed.

Although the Figures illustrate an exercise apparatus 10 in which the shuttles 32*a*,32*b* move along a respective rail assembly 24*a*,24*b*, which each comprise a pair of parallel curved rails 26,26', the rail assemblies 24 could each consist of either a single rail or three or more rails configured to guide a shuttle 32 associated therewith in the desired degree of arcuate movement. While the detailed description describes and illustrates the tracks 24*a*,24*b* as curving downwardly rearward towards their respective distal ends 27*a*, 27*b*, other track configurations are also possible. For example, the tracks 24*a*,24*b* could be formed either substantially flat, or the tracks 24*a*,24*b* could slope rearwardly to the distal ends 27*a*,27*b* at a constant angle.

Figure 11:
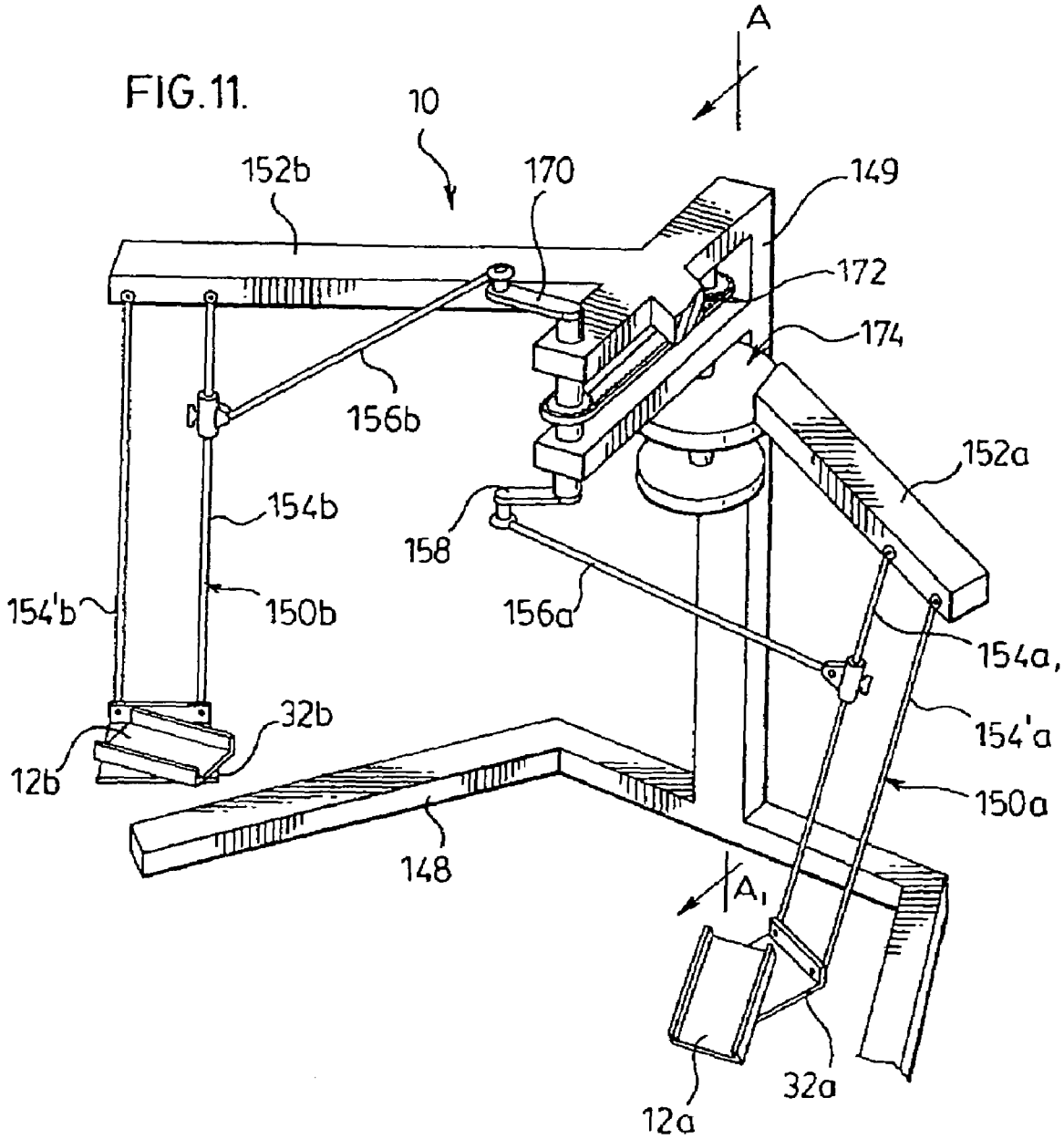
FIG. 11 shows a perspective view of an exercise apparatus in accordance with a further embodiment of the invention.

Although the preferred embodiment of the invention describes the pedals 12*a*,12*b* as being movable along a set of tubular steel rails 26,26', the invention is not so limited. It is to be appreciated that other constructions which do not incorporate a tubular frame 21 and/or guide tracks 24*a*,24*b*, are also envisioned by the inventor and will now become apparent. By way of non-limiting example, FIG. 11 shows an alternate possible apparatus 10 which is adapted to simulate skating movement and wherein like reference numerals are used to identify like components. In the exercise apparatus 10 of FIG. 11, a pair of foot pedals 12*a*,12*b* are provided for supporting the feet of a user standing in a forward facing position thereon. As with the apparatus 10 shown in FIG. 1, the apparatus 10 of FIG. 11 is symmetrical about its central mid-plane A-$A_1$.

In use, the apparatus 10 is adapted to supportingly move each foot of the user along respective predetermined paths which extend largely mirror arrangement about the plane A-$A_1$ from a respective raised proximal upper position curving downwardly and extend rearwardly outward to a lower distal moved position. The apparatus 10 includes a lower frame 148 which is adapted to rest on the floor. The frame 148 includes an axially forward positioned vertical support 149 which extends to a height of approximately one meter above the floor. A pair of support arms 152*a*,152*b* are coupled to an upper end of the vertical support 149. The support arms 152*a*,152*b* extend in a mirror arrangement substantially horizontally and in an orientation angling rearwardly and outwardly relative to the mid-plane A-$A_1$. As shown best in FIG. 11, a rocker arm assembly 150*a*,150*b* is pivotally suspended from an end portion of each support arm 152*a*,152*b*, respectively. As will be described, the rocker arm assemblies 150*a*,150*b* are used to mount a respective shuttle 32*a*,32*b* which each in turn pivotally supports a respective pedal 12*a*,12*b*.

The rocker arm assemblies 150*a*,150*b* are provided to guide the pedals 12*a*,12*b* in movement along a respective predetermined path which curves downwardly and extends rearwardly outward relative to the central mid-plane A-$A_1$ of the apparatus 10 without tracks.

As shown in FIG. 11, the foot pedals 12*a*,12*b* are pivotally mounted for movement relative to each shuttle 32*a*,32*b*. A pivot arm 156*a*,156*b* connected to a crank mechanism 158 (shown best in FIG. 17) is used to impart pivoting movement on an associated rocker arm assembly 150*a*,150*b*. In particular, as shown best in FIGS. 11 and 17, each rocker arm assembly 150*a*,150*b* consists of a pair of parallel spaced pivotal rod members 154*a*,154'*a* and 154*b*, 154'*b* which are adapted to be pivoted in the outwardly rearward direction of the support arms 152*a*,152*b*. The reciprocal pivoting movement of the rocker arm assemblies 150*a*,150*b* enables movement of the shuttles 32*a*,32*b* and pedals 12*a*,12*b* along a respective predetermined path between a forward raised proximal position, when the shuttles 32*a*,32*b* are moved closest to the mid-plane A-$A_1$, and which curves downwardly to a rearward lower distal position, as the shuttles 32*a*,32*b* are moved rearwardly therefrom.

The pivot arms 156*a*,156*b* are used to link the crank mechanism 158 to a respective rocker arm 154*a*,154*b* to provide for the reciprocal return movement of the shuttles 32*a*,32*b*. Furthermore, the pivoting movement of the pedals 12*a*,12*b* relative to the shuttles 32*a*,32*b* allows the user's foot to twist and point outwardly as each pedal 12*a*,12*b* moves rearwardly and downward, to assist in maintaining the user's foot in a more natural neutral position as is or her leg is extended.

Figure 16:
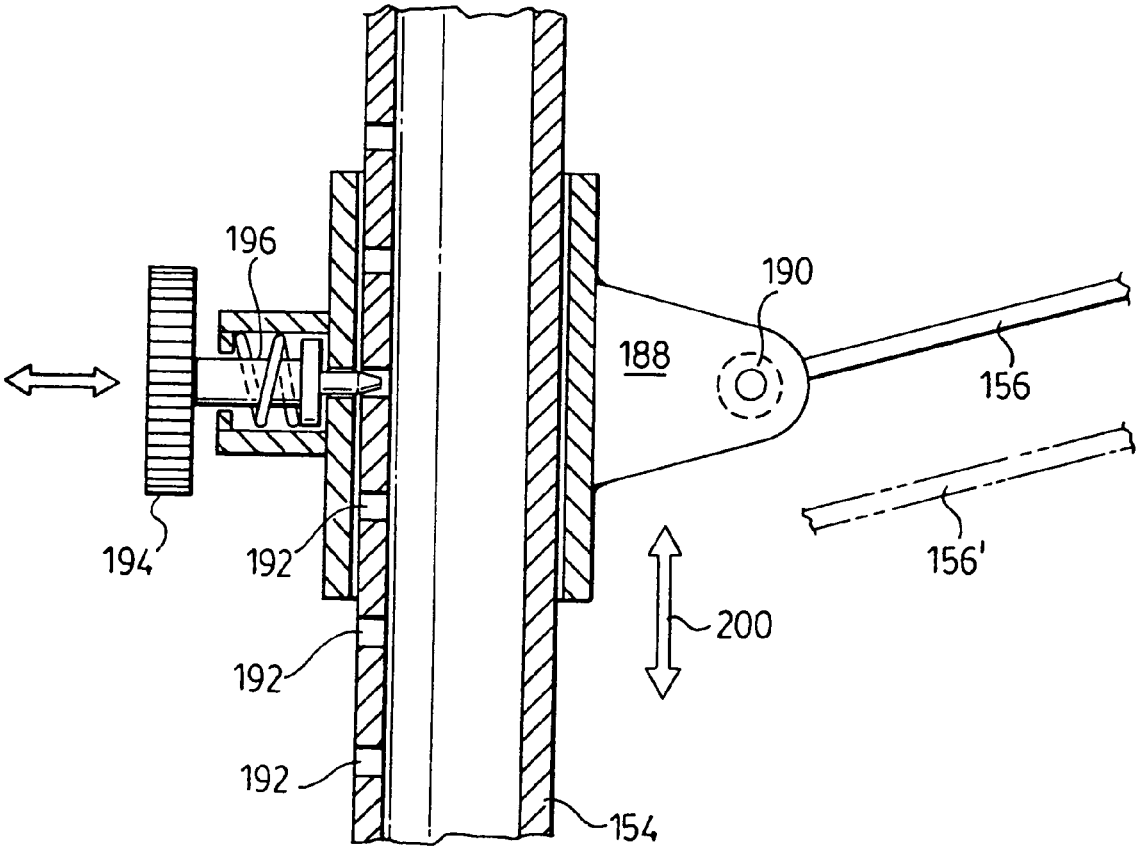
FIG. 16 illustrates an enlarged schematic view showing the attachment of a pivot arm to one of rocker arms used in the apparatus of FIG. 11.

FIG. 16 shows a partial schematic illustration of the pivot arm 156 connection to each rocker arm 154. Most preferably, the pivot arms 156 are adapted to be coupled at a number of vertically spaced locations to each rocker arm 154, thereby permitting adjustment in the overall length of the path of pivotal movement of the shuttles 32*a*,32*b* in reciprocal movement. FIG. 16 shows best one end of the pivot arm 156 as being pivotally secured to a slidable sleeve 188 by means of a rod end bearing 190. The sleeve 188 is slidable in the direction of arrow 200 along a portion of the length of the rocker arm 154, as for example to the position shown in phantom with reference to pivot arm 156'. The rocker arm 154 further includes a number of spaced adjustment holes 192. A locating pin 194 coupled to the sleeve 188 is resiliently biased by means of a helical spring 196 into engagement with a selected adjustment hole 192 to couple the pivot arm 156 at the desired location. It is to be appreciated, by raising or lowering the sleeve 188 relative to the rocker arm 154, the degree of downward curving movement of the foot pedals 12*a*,12*b* may be adjusted to better suit the skill of the user.

Figure 12:
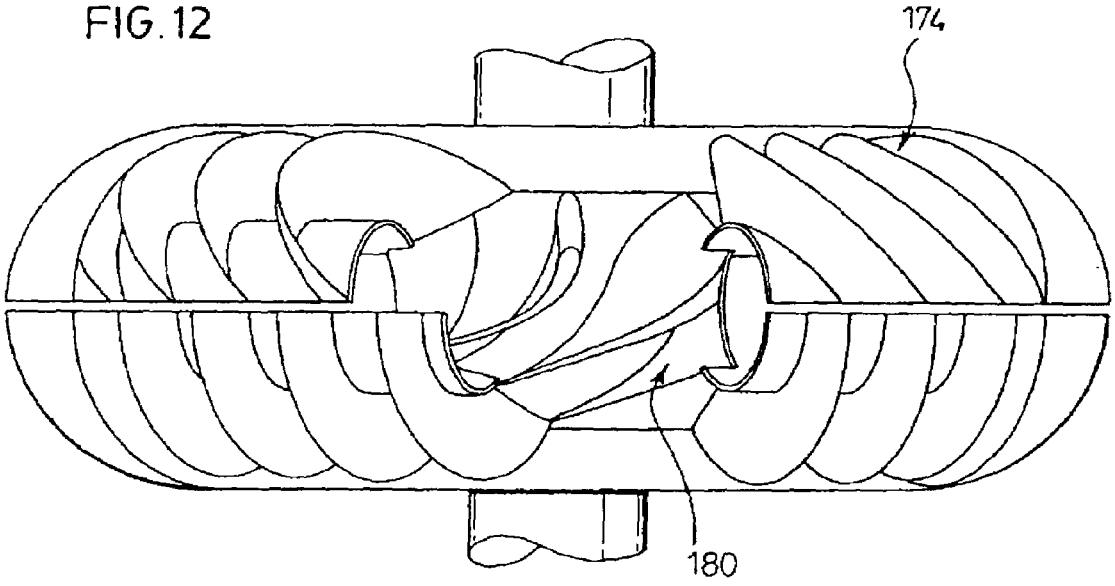
FIG. 12 illustrates a schematic partially cutaway view of a torque converter for use in the exercise apparatus of FIG. 11.
Figure 13:
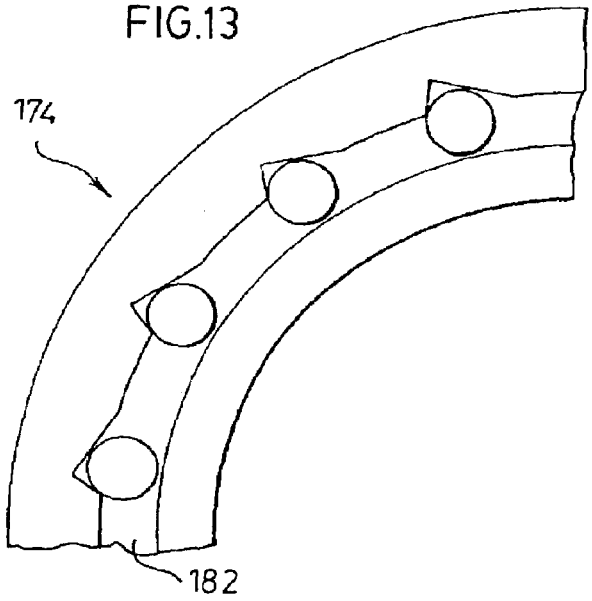
FIGS. 13 to 15 illustrate one-way clutch constructions to be used with the torque converter of FIG. 12.
Figure 14:
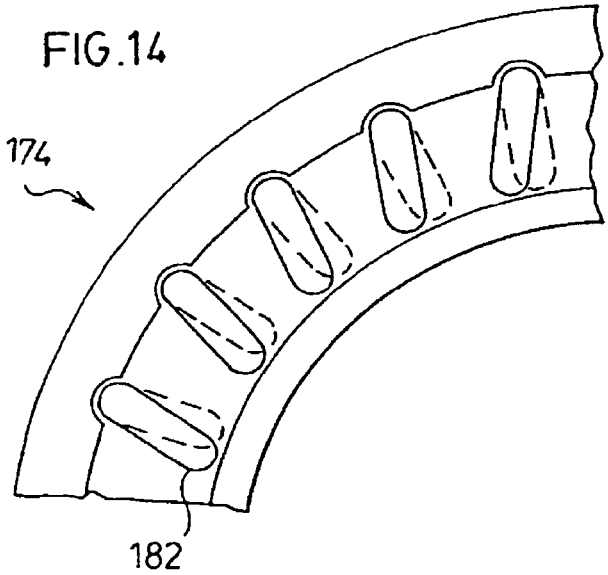
Figure 15:
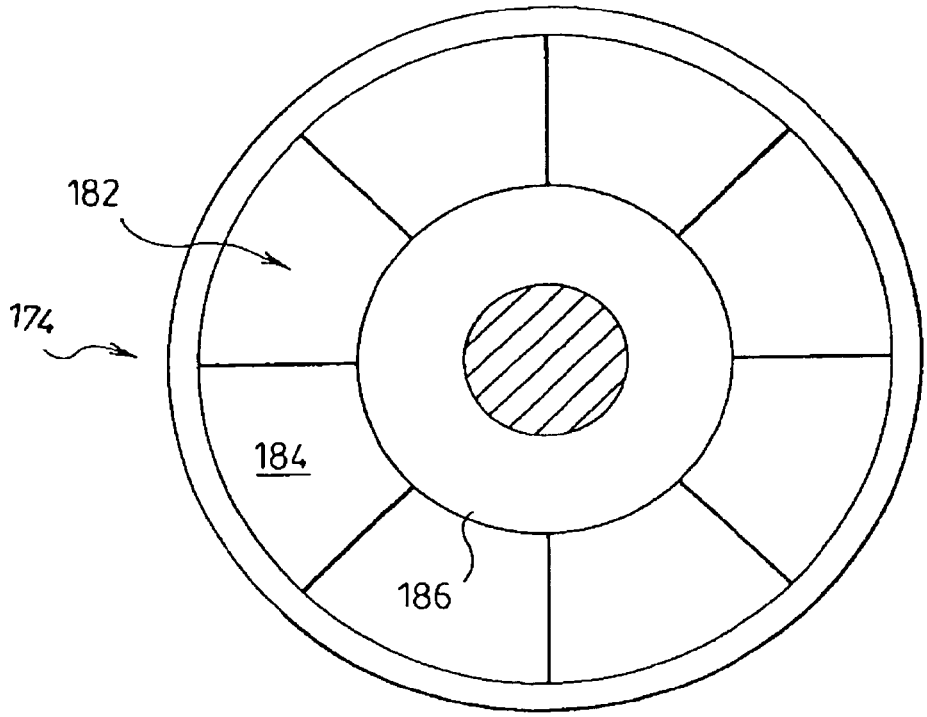
Figure 17:
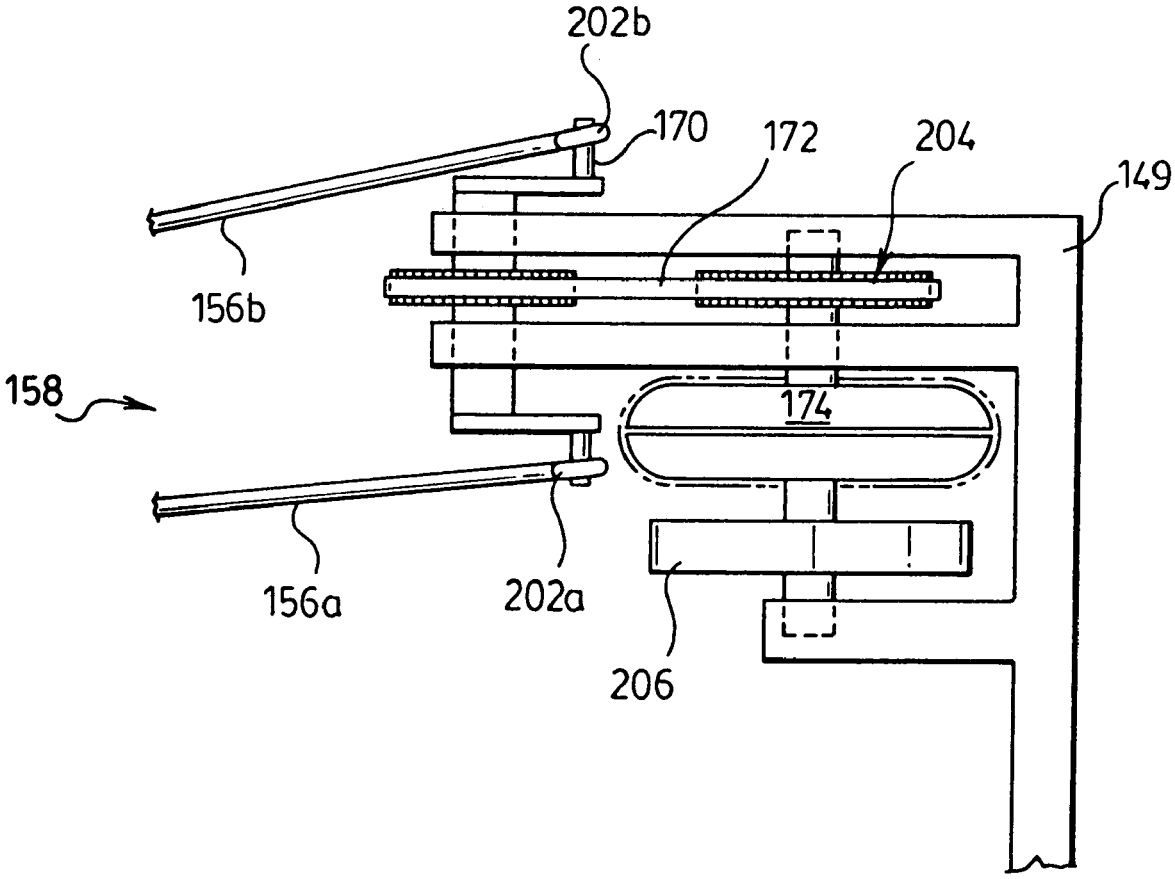
FIG. 17 shows schematically a side view of the crank mechanism 158 used to actuate the pivot arms in the apparatus of FIG. 11.

FIG. 17 shows the crank mechanism 158 as including a crank arm 170 which is driven in rotary movement by a driven chain or belt 172. The drive belt 172 is in turn driven by means of a suitable torque converter 174 by way of a gear 204. As shown in FIG. 12, the torque converter 174 incorporates a stator 180 and one-way clutch mechanism 182 to maintain single directional rotation of the crank arm 170. Possible suitable one-way clutch mechanisms 182 for unidirectional movement of the torque converter 174 are shown in FIGS. 13 to 15 as possibly comprising a roller one-way clutch (shown in FIG. 13), a sprag clutch (shown in FIG. 14) or a hydraulic-type clutch 182 of the type of FIG. 15. The one-way clutch of FIG. 15 includes a segmented chamber 184 which is adapted to hold a suitable clutch fluid 186. The segmented walls of the chamber 184 thus preventing or restricting rotational movement of the fluid 186 within the torque converter 174. The crank arm 170 is provided at each end with a spherical bearing 202*a*,202*b*. Each of the spherical bearings 202*a*, 202*b* are used to pivotally secure an end of the respective pivot arms 156*a*,156*b* to upper and lower ends of the crank arm 170. The belt 172 is used to translate the unidirectional rotational movement from the torque converter 174 via gear 204 to the crank arm 170 to effect its rotation. A weight 206 may further be provided as an inertia device to maintain momentum.

Figure 18:
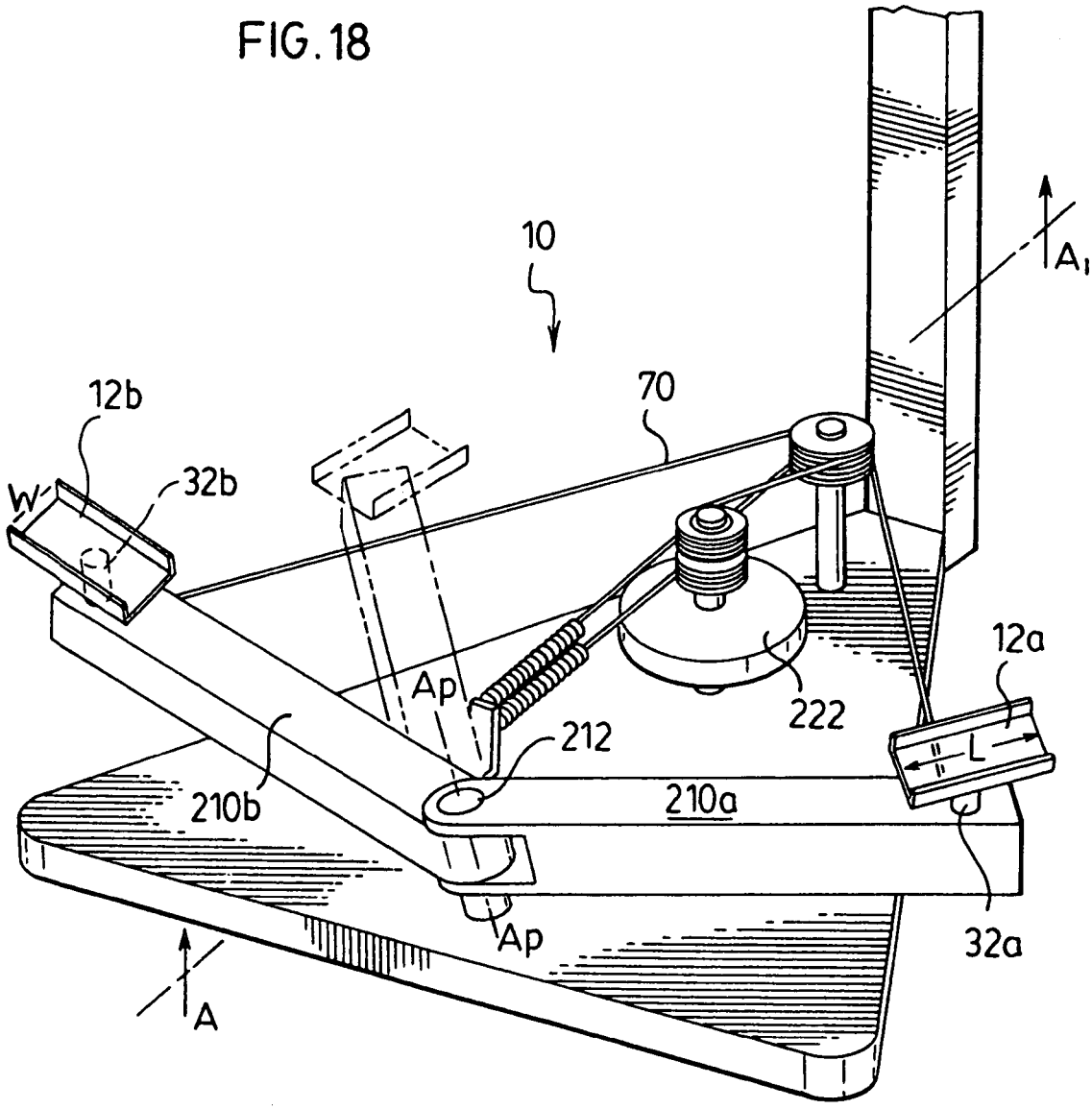
FIG. 18 shows a schematic view of an exercise apparatus in accordance with a further embodiment of the invention.

FIG. 18 shows an alternate possible construction for the apparatus 10 used to simulate skating movement in which like reference numerals are used to identify like components. In the apparatus of FIG. 10, a pair of rigid steel swing arms 210*a* are provided to guide the user's feet in downwardly and rearwardly curving movement. Each of the swing arms 210*a*,202*b* are mounted to a pivot 212. Preferably, the pivot 212 is positioned along the mid-plane A-$A_1$ of the apparatus 10 towards a rearward location, such that the pivoting axis $A_p$—$A_p$ locates rearwardly of a user in use of apparatus 10. A shuttle 32*a*,32*b* is secured towards a forwardmost end of each swing arm 210*a*,210*b*, respectively. As with the earlier embodiments, each shuttle 32*a*,32*b* supports a respective pedal 12*a*,12*b* used to support the foot of a user in a generally forward facing position on the apparatus 10. FIG. 18 further shows a flexible cable 70 as being used to couple the forward end portions of the swing arms 210*a*,202*b* to each other in return reciprocal movement.

Figure 22A:
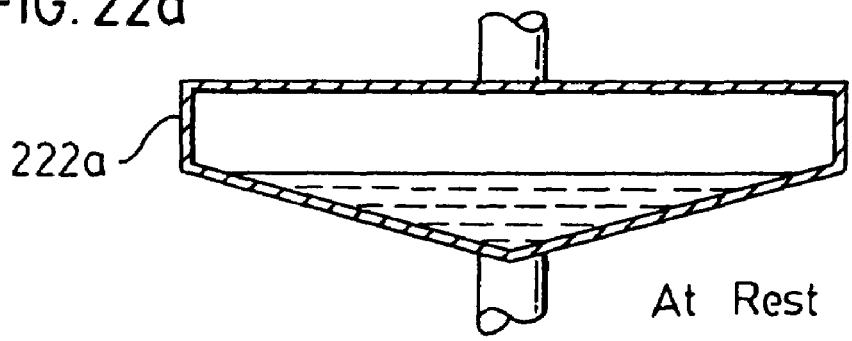
FIGS. 22*a* and 22*b* illustrate schematically a hydraulic clutch mechanism used for providing resistance in the apparatus of FIG. 18.
Figure 22B:
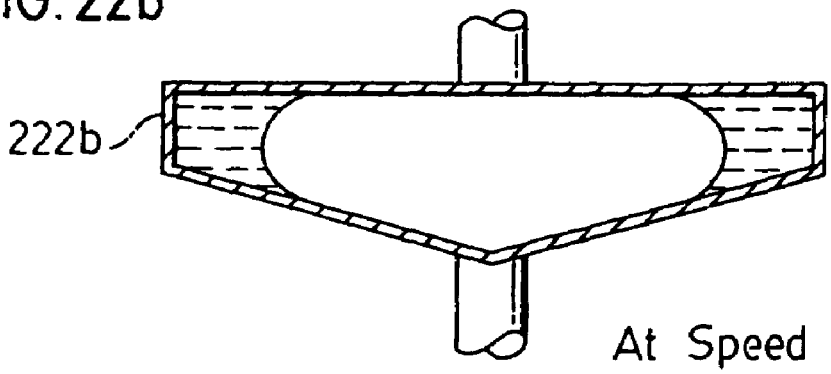

FIG. 18 further shows the apparatus as including a torque converter 222. In a simplified construction, the torque converter 222 may comprise a hydraulic torque converter which includes a suitable fluid which as shown best in FIGS. 22*a* and 22*b* is selected to provide resistance as the pedals 12*a*,12*b* are reciprocally moved. Other types of torque converts 222 including those described with reference to the embodiment shown in FIG. 11 may, however, also be used.

Figure 19:
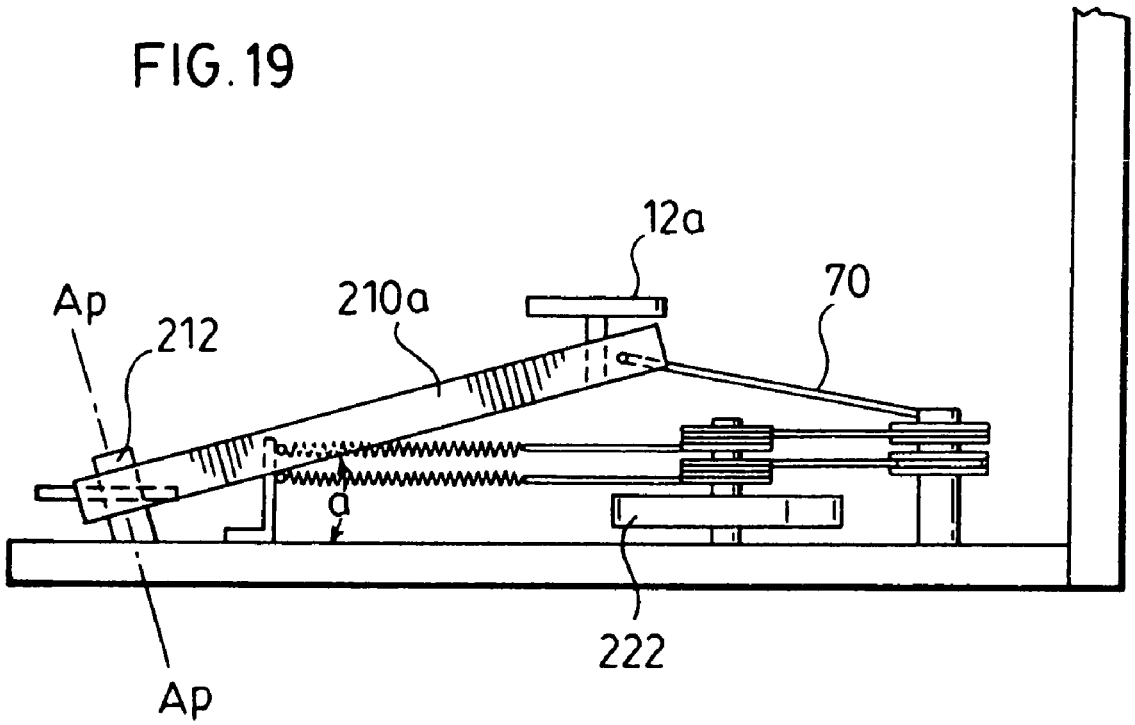
FIG. 19 shows a schematic side view of the exercise apparatus of FIG. 18.
Figure 20:
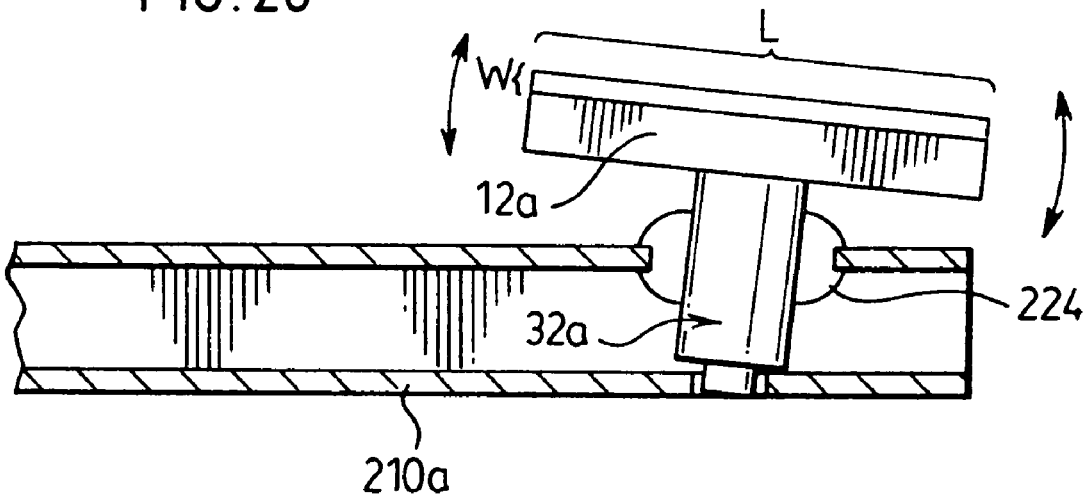
FIG. 20 illustrates schematically a preferred shuttle and foot pedal mount used in the exercise apparatus of FIG. 18.

FIG. 20 shows a preferred shuttle mount for use with the left swing arm 210*b* of the apparatus 10 of FIG. 18, the right swing arm 210*a* being identical. In particular, the pedal 12*b* is most preferably rotatable relative to the swing arm 210*b* to allow the repositioning of the user's foot and ankle in the neutral position as each pedal 12*b* is pivoted away from the plane A-$A_1$. In one simplified construction, the shuttle 32 includes a urethane pad 224 which permits angular deflection of the pedals 12*b* as the swing arm 210*b* is pivoted. In FIG. 20, the urethane pad 224 is selected to permit not only the inclination of the pedal 12*b* in generally a direction of pedal movement laterally at an angle of between about 15 to 50° relative to the horizontal as the pedal moves outwardly rearward, but also with an angular deflection relative to the pedal length L (FIG. 19), so that the pedal 12*b* tilts downward in the direction of its longitudinal length and outwardly generally transverse to the path of shuttle movement at an angle of up to 45°, and preferably 15 to 30° and more preferably about 25°. The downward tilting of the pedal 12*b* advantageously assists in pointing to the user's toes in a generally downward orientation as his or her leg is extended.

Figure 21:
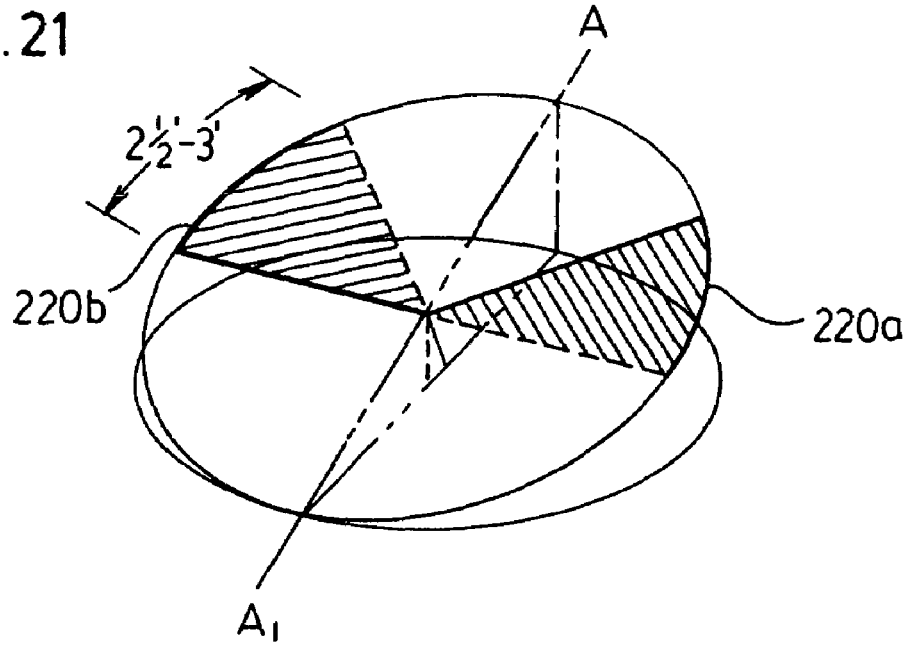
FIG. 21 illustrates the geometric path of movement of the foot pedals using the exercise apparatus of FIG. 18.

As shown best in the profile of FIG. 19, in a simplified construction the pivot 212 is oriented in a rearwardly inclined position. As a result, when moved to a forward position so that the shuttles 32*a*,32*b* are moved closest to the mid-plane $A_1$—$A_1$, the swing arms 210*a*,202*b* are inclined upwardly in the forward direction at an angle α which preferably is selected at between 5 and 35°, and more preferably about 30°. As shown in FIG. 21, the forward inclination of the swing arms 210*a*,202*b* permits movement of the foot pedals 12*a*,12*b* to move along a respective predetermined rearwardly curving path 220*a*,220*b* which slopes from a forward position downwardly and rearwardly to a rearward position. Most preferably, each swing arm has a length selected at between about 0.5 and 1.5 meters with the result that the predetermined paths 220*a*,220*b* have an arcuate length of between about 0.75 and 3 meters. It is to be appreciated that with the apparatus 10 of FIG. 19, the apparatus provides for outwardly rearward curving movement of the pedals 12*a*,12*b*. By transferring the user's weights from pedal 12*a* to 12*b*, the user's feet are guided in reciprocal movement along respective predetermined paths extending away from each other in a generally mirror arrangement from raised proximal upper positions, so as to slope on a constant angle downwardly and rearwardly to a lower distal position.

Although FIG. 18 illustrates the apparatus 10 as incorporating a single pivot 212, it is to be appreciated that in a less preferred construction, each of the swing antis 210*a*,210*b* could be mounted to separate pivots, each spaced generally towards the axis-plane A-$A_1$ for downwardly and rearwardly curving movement.

FIG. 23 shows alternate possible construction for the swing arm 210*b*(swing arm 210*a* being identical) and shuttle 32*b* for use in the apparatus of FIG. 18. In FIG. 23, the shuttle 32*b* is provided with a helically threaded shaft 230. The helically threaded shaft 230 is threadedly engaged wit a complementary internally threaded socket 232 formed in the forwardmost end of the swing arm 210*b*. The helical threads may be provided with a constant thread pitch or spacing along their length, but more preferably include a wider thread pitch towards an upper end of the shaft 230 It is to be appreciated that as the swing arm is moved about the pivot 212, the placement of the user's foot on the pedal 12*b* results in the rotational movement of the pedal 12*b* and shaft 230 relative to the socket 232 and end of each swing arm 210*b*. The threaded engagement of the shaft 230 and socket 232 thus results in the pedal 12*b* moving vertically in the direction of arrows 240*a*,240*b* relative to the swing arm 210*a*,202*b* at different rates depending on the swing arm 210 position to achieve simultaneous downward and rearward curving movement of the user's foot as each swing arm 210*a*,202*b* is pivoted from the position shown in phantom rearwardly from the plane A-$A_1$.

FIG. 24 shows a modified threaded mount for use with the construction shown in FIG. 23. In a further possible construction, a belt drive 242 could be used to engage a toothed sprocket 244 to provide exaggerated vertical movement of the threaded shaft 230 in the direction of arrow 240 as each swing arm 210 is pivoted. The belt drive 242 may optionally be threadedly engaged with a corresponding tooth surface provided on the pivot 212.

FIG. 25 illustrates schematically the geometry of movement of the pedals 12*a*,12*b* along a respective arcuate path (shown by arrows 252*a*,252*b*) relative to the mid-plane A-$A_1$ of the apparatus 10. As shown, the swing arm 210 and shuttle 32 construction of FIG. 23 is adapted to effect movement of the pedals 12*a*,12*b* in a mirror arrangement and reciprocally along the respective predetermined paths 252*a*,52*b* from a respective raised position which is spaced forwardmost and proximate to each other, curving continuously rearwardly and downwardly in the direction of the arrows 250*a*,250*b* to a lower rearward and outward position.

As with the construction shown in FIG. 20, as each pedal 12*a*,12*b* moves downwardly rearward, the pedal 12*a*,12*b* tilts in their longitudinal direction transverse to the path of pedal movement to allow movement of the user's toe to point outwardly, and more preferably so as also to point downward. More preferably, the pedals 12*a*,12*b* are adapted to simultaneously tilt lataerally forwardly concurrently with their outward rotation, as for example by inclusion of the urethane sleeve 224 (FIG. 20) to assist in maintaining the user's foot in more of a neutral position, minimizing ankle strain.

Figure 27:
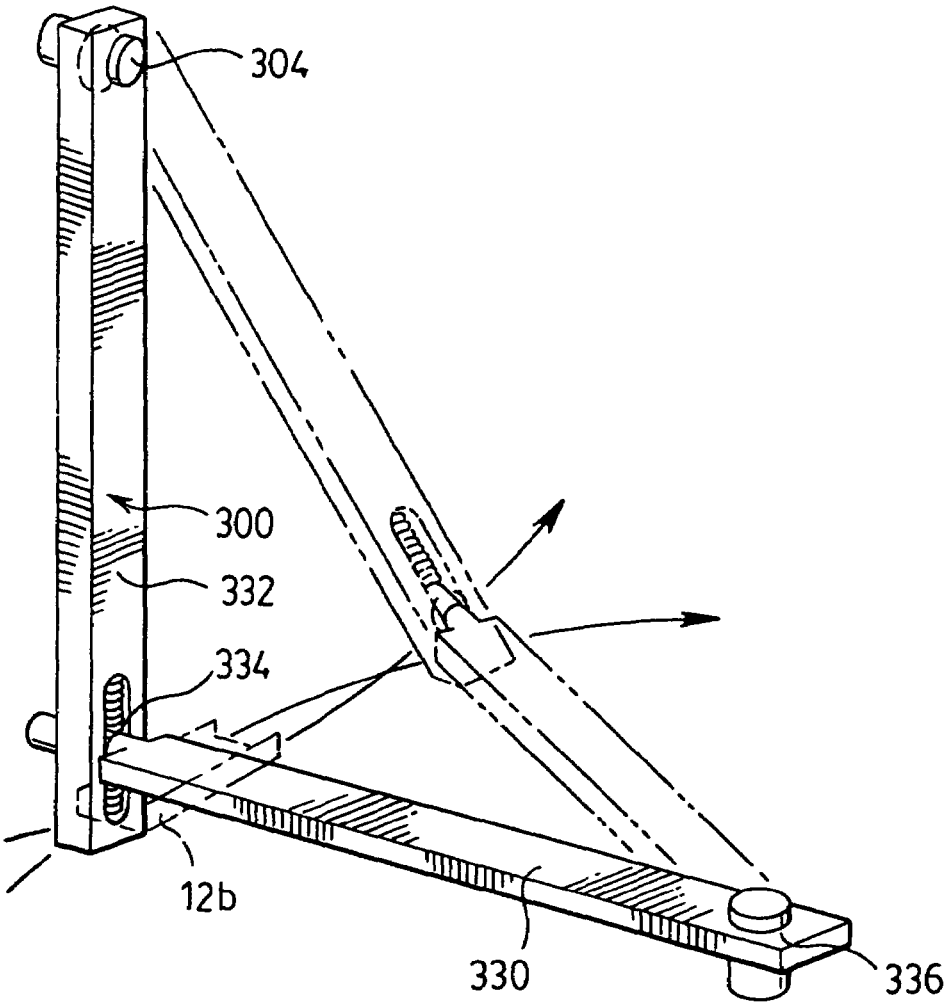
FIG. 27 illustrates an exercise apparatus in accordance with another embodiment of the invention.

FIGS. 26 and 27 illustrate a further embodiment of the invention in which like reference numerals are used to identify like components. Each of FIGS. 26 and 27 show in isolation a support member 300 which is adapted to support a left foot of a user. The support member 300 is for use with an apparatus frame (not shown) in supporting the left foot when the user stands standing in the forward facing position on the exercise apparatus. It is to be appreciated that an identical support structure is provided to support the user's right foot, and wherein left and right support members 300 are mounted symmetrically positioned about a central mid-axis of the exercise apparatus.

FIG. 26 illustrates the support member 300 as including a generally J-shaped steel tube 302. The upper end of the tube 302 is mounted by means of a spherical bearing 304 to the apparatus frame (not shown) so as to be pivotal in approximately 360° movement thereabout. The foot pedal 12*b* is secured to the lower end of the J-shaped tube 302. A tensioning cable 310 is coupled at one of its ends to the end of the tube 302, and at the other end to an anchor shaft 312. Optionally, a movable cam 314 maybe provided to permit adjustment in the pivot length of the bottom end of the tube 302. The cam 314 is movable radially in the direction of arrows 350 in a selected number of positions. As is apparent, by moving the cam 314, it is possible to vary the radius of curvature along which the path of the lower end of the J-shaped tube 302 moves.

Figure 28:
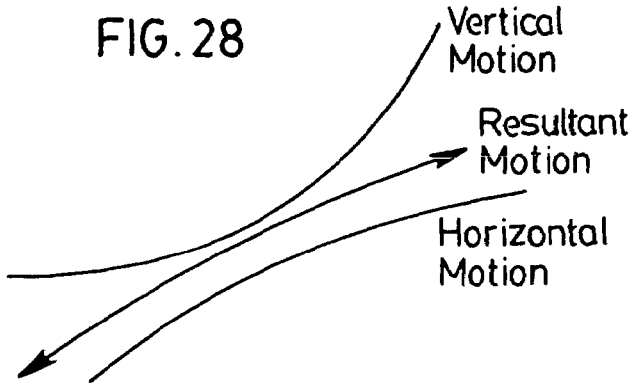
FIG. 28 illustrates the geometric path of movement of the foot pedals of the apparatus of FIGS. 26 and 27.

FIG. 28 shows schematically the geometry of movement of the pedal 12*b* with the tube 302 of FIG. 26. As shown best in FIG. 28, a skating apparatus 10 incorporating the support 300 as shown in FIG. 26 permits a user to stand on the pedals (12*b* shown) enabling the pedal 12*b* to move in a radially outwardly and downwardly path from a forward raised position to a lower rearward position. Although not shown, it is to be appreciated that an appropriate return member such as a spring or cable may be used to couple the lower ends of similarly mounted J-shaped members 300 mounted in a mirror arrangement to provide for reciprocal movement of a pair of pedals 12 along respective predetermined paths.

FIG. 27 shows an alternate possible support frame member 300 to that shown in FIG. 26, wherein like reference numerals are used to identify like components. In place of the tensioning cable 310, the construction of FIG. 27 incorporates a second rigid horizontal metal or composite bar 330. The bar 330 is coupled at a first end to a vertical frame member 332 by way of a spherical joint 334, and at its second other end to a further spherical joint 336. As with the embodiment shown in FIG. 26, the support member 300 is adapted to guide individual foot pedals (foot pedal 12*b* shown in phantom) along a predetermined path shown graphically in FIG. 28 from a raised proximal upper position and curving substantially continuously downwardly and rearwardly to a lower distal moved position. As with the embodiment shown in FIG. 20, the pedal 12*b* may, for example, be mounted to guide assembly for pivoting movement along a urethane plastic or other rubber-type pad 224 to accommodate for angular deflection and/or inclination as each pedal 12 is moved downwardly rearward.

Although the detailed description describes and illustrates a preferred apparatus construction, the invention is not so limited. Many variations and modifications will now appear to persons skilled in the art. For a definition of the invention reference may be had to the appended claims.

I claim:

1. A skating exercise apparatus for simulating skating or roller blading movement in a user, said apparatus extending generally in a front-to-back direction and including, a pair of shuttles, each of said shuttles for supporting a foot of said user standing in a generally forward facing position thereon facing towards a front of the apparatus, a pair of guide assemblies, each guide assembly supporting and limiting an associated one of said shuttles in reciprocal movement along a respective associated predetermined path, and wherein said shuttles are movable by said guide assembly along said associated predetermined path, each of said predetermined paths consisting of a path extending in a direction away from the other in a generally mirror arrangement about a central plane of the apparatus such that the paths do not substantially cross the central plane and extend from a respective raised proximal upper portion and curving rearwardly and extending downwardly to a lower distal portion, and whereby each of the shuttles are alternating reciprocally movable along said associated predetermined paths with a foot of the user thereon from a respective raised proximal upper position with the shuttle being spaced towards the front of the apparatus, to a lower distal position wherein the shuttle is moved rearwardly therefrom, and wherein when a first one of said shuttles is positioned in said proximal upper position, the second other shuttle being positionable in the distal position to move the user's feet generally in simulated skating or roller blading movement.

2. The exercise apparatus of claim 1 wherein each said guide assembly includes a guide rail, said apparatus further including a guiding mechanism for guiding an associated shuttle in movement along the guide rail, the guiding mechanism having at least one wheel rotatably engaging the said guide rail for rolling movement therealong.

3. The exercise apparatus of claim 1 further including a return device for biasing the shuttles to an initial starting position spaced towards the proximal upper position.

4. The exercise apparatus of claim 3 wherein said return device is selected from a flexible wire cable, a resiliently extendable spring and a resiliently extendable shock cord.

5. The exercise apparatus of claim 1 further including a tensioning mechanism selectively operable to permit said user to vary resistance to the movement of said shuttles in at least one direction along said predetermined path.

6. The exercise apparatus as claimed in claim 1 wherein each of said guide assemblies comprise a pivotally movable elongated support arm extending from a respective rearward end to a forward end, the associated one of said shuttles being mounted to the forward end of each support arm for pivotal movement relative thereto, the rearward end of each support arm being mounted to a pivot joint for selective reciprocal rotational movement thereabout from a first position wherein said forward end is moved with said associated shuttle positioned at said raised upper position, and a second position wherein said associated shuttle is positioned in said lower distal position.

7. The exercise apparatus of claim 1 further including a pair of pedals being mounted to a respective shuttle and having a pedal surface sized to support a foot of said user standing thereon, when said shuttle is in the lower distal position, said pedal surface in an orientation inclined substantially in a direction of said predetermined path relative to the horizontal, an angle at between about 15 and 50°, to support said user's foot thereon oriented in a generally outward sideways orientation.

8. The exercise apparatus of claim 7 wherein when said shuttle is in said upper position said pedal surface in an orientation inclined relative to the horizontal at an angle of between 0 and ±15°.

9. The exercise apparatus of claim 7 wherein said guide assemblies each comprise guide rails, the guide rails each including a rail portion which each curves in a mirror arrangement continuously downwardly and rearward from respective raised proximal upper end portions to lower distal end portions, and a tensioning mechanism selectively operable by said user to vary resistance to the movement of said shuttles in at least one direction along an associated one of said rail portions.

10. The exercise apparatus of claim 9 further including a return device for biasing the shuttles to an initial starting position spaced towards the proximal end portion of said associated guide rail.

11. The exercise apparatus as claimed in claim 7 wherein in said lower distal position said pedal is positioned in an orientation generally transverse to said direction of said predetermined path at an angle of between about 15° and 30° relative to horizontal to position the toes of said user's foot thereon in a generally downwardly extending orientation.

12. The exercise apparatus as claimed in claim 1 wherein each of said shuttles further includes a planar pedal surface, in the lower distal position the shuttle pedal surface is positioned in an orientation inclined generally in a forward direction of said apparatus at an angle inclined at between 15 and 50° relative to the horizontal.

13. The exercise apparatus as claimed in claim 12 wherein when the shuttle is in the upper position, the pedal surface is positioned in an orientation inclined at an angle relative to the horizontal at between 0 and ±15°.

14. The exercise apparatus as claimed in claim 13 wherein when the shuttle is in said lower distal position, said pedal surface is positioned in an orientation selected to align a foot of said user thereon generally transversely to said direction of said predetermined path and inclined at an angle of between about 15° and 30° relative to horizontal.

15. The exercise apparatus of claim 1 wherein each shuffle further includes a pedal having a pedal surface sized to support said user's foot thereon, in the lower distal position the pedal surface inclined in a direction generally transverse to the direction of the predetermined path at an angle inclined relative to the horizontal for supporting said user's foot thereon with the toes pointing in a generally downwardly inclined orientation.

16. The exercise apparatus of claim 15 wherein in the lower distal position the pedal surface is inclined at an angle of between about 15 and 30°.

17. An exercise apparatus extending generally in a front-to-back direction and comprising, a pair of shuttles, each for movably supporting a foot of a user standing in a generally forward facing position thereon facing towards a front of the apparatus and including a shuttle frame, a guide assembly, said guide assembly supporting and limiting each said shuttle in reciprocal movement along an associated predetermined path, said predetermined paths oriented in a substantially mirror arrangement and each extending in a direction away from the other such that the paths do not substantially cross a central plane and extend from a generally adjacent raised proximal upper end portion spaced towards the front of the apparatus, and curving continuously downwardly and rearwardly to a lower distal end portion rearwardly from the proximal upper end portion, each of the shuttles being substantially restricted in movement along said associated predetermined path between a raised forwardmost position spaced towards the upper end portion and a lowered rearward position spaced towards the lower distal end portion, and wherein when a first one of said shuttles is positioned in said proximal upper position, the second other shuttle being positionable in the distal position to move the user's feet to substantially simulate a lateral motion of the user's foot movement during skating.

18. The exercise apparatus of claim 17 further including a return device for biasing the shuttles to an initial starting position adjacent the proximal end portion.

19. The exercise apparatus of claim 18 wherein said return device is selected from a resiliently extendable spring and a resiliently extendable shock cord.

20. The exercise apparatus of claim 17 further including a tensioning mechanism operable to permit said user to vary resistance to the movement of said shuttles in at least one direction along said predetermined path.

21. The exercise apparatus of claim 17 wherein each said shuttle further comprises, a plate mounted to said frame and sized to substantially support at least part of one of said user's feet with said user standing thereon, said frame including a proximal plate support spaced closest towards said proximal end portion of said associated predetermined path, and a distal support spaced closest towards said distal end portion of said predetermined path, said distal plate support extending vertically a distance greater than said proximal plate support whereby said plate is inclined forwardly as said shuttle moves along the associated predetermined path from the proximal end portion towards the distal end portion.

22. The exercise apparatus of claim 21 wherein said proximal plate support and said distal plate support extend by a distance selected so that said plate assumes an orientation inclined at between 0 and ±15° when the shuttle is located adjacent to the proximal end portion.

23. The exercise apparatus as claimed in claim 17 wherein said guide assembly comprises a pair of guide rails which continuously curve downward and rearwardly from proximatemost raised upper ends to lowermost distal ends.

24. The exercise apparatus as claimed in claim 17 wherein each of said shuttles further includes a pedal having a longitudinal length and a lateral width for supporting said user's foot, when said shuttle is at said lower distal position said pedal being positioned with its longitudinal length in an orientation inclined in a first generally transverse direction to said predetermined path at an angle of between about 15° and 30° relative to horizontal to position the toes of said user's foot thereon in a generally downwardly extending orientation.

25. The exercise apparatus as claimed in claim 24 wherein in the lower distal position the pedal is moved to an orientation with its lateral width inclined in a second generally forward direction of said apparatus at an angle of between 15 and 50° relative to the horizontal.

26. The exercise apparatus as claimed in claim 24 wherein when the shuttle is in the upper position the said pedal is oriented at an inclined angle relative to the horizontal of between 0 and ±15°.

27. An ice skating or roller blading exercise apparatus, the apparatus generally extending in a front-to-back direction and including a handle member provided towards a forward end of the apparatus, a pair of shuttles for movably supporting a foot of a user standing in a generally forward facing position thereon facing the forward end of the apparatus, a guide assembly limiting movement of said shuttles in reciprocal movement along an associated predetermined path, each of said predetermined paths extending generally in a direction away from a central plane of the apparatus such that the paths do not substantially cross the central plane and extend from a respective forward proximal portion spaced towards the forward end of the apparatus and curving outwardly and rearwardly to a respective lower distal portion spaced rearwardly therefrom, said shuttles being substantially limited in reciprocal movement along said associated predetermined path, and wherein when a first one of said shuttles is positioned towards said proximal portion, the second other shuttle being positionable at the distal portion to enable movement of the user's feet in a lateral motion generally simulating skating or roller blading movement.

28. The exercise apparatus of claim 27 wherein said guide assembly comprises a pair of rails, each said rail associated with a respective shuffle and curving in the direction of said respective predetermined path downwardly and rearward from a proximal end adjacent the proximal portion of said respective path towards a distal end adjacent the distal portion of said respective predetermined path, the apparatus further including a return device for biasing the shuttles to an initial staffing position spaced towards the proximal end of said associated rail, and a tensioning mechanism selectively operable to permit said user to vary resistance to the movement of said shuttles towards the distal end portion.

29. The exercise apparatus of claim 28 wherein each of said shuttles further comprise, a generally planar plate sized to support at least part of one of said user's feet thereon, said planer plate being pivotal coupled to a remaining portion of said shuttle, a frame including a proximal support spaced towards said proximal end of the associated rail, and supporting a proximate-most portion of said plate, and a distal support spaced towards said distal end of said associated rail and supporting a distal-most portion of said plate, and wherein said distal support extends from said associated rail a height selected generally greater than that of said proximal support.

30. The exercise apparatus of claim 28 wherein each of said shuttles further comprise, a pedal comprising a planar plate sized to support one of said user's feet thereon, a frame including a proximal support spaced towards said proximal end of said associated rail, and supporting a proximate-most portion of said plate, and a distal support spaced towards said distal end of said associated rail and supporting a distal-most portion of said plate, said distal support extending from said associated rail a height selected generally greater than that of said proximal support, and wherein said proximal and distal support extends a height above said associated rail by a distance selected so that said plate assumes an orientation inclined relative to the horizontal at between 0 and ±15° when the shuttle is moved to a position adjacent to the proximal end, and inclined at between about 15 and 50° when the shuffle is moved to the distal end.

31. The exercise apparatus as claimed in claim 27 wherein each said shuttle includes a generally planar support surface for supportingly engaging said user's foot, when said shuttle is moved to the lower distal portion of said predetermined path the support surface being positioned in an orientation inclined generally in a forward direction of said apparatus at an angle inclined at between 15 and 50° relative to the horizontal.

32. The exercise apparatus as claimed in claim 27 wherein each said shuttle includes a generally planar support surface for supportingly engaging said user's foot when said shuttle is moved to the proximal portion of the predetermined path, the support surface being positioned in an orientation inclined at an angle relative to the horizontal at between 0 and 15°.

33. The exercise apparatus as claimed in claim 27 wherein each said shuttle includes a generally planar support surface for supportingly engaging said user's foot, when said shuttle is moved to said lower distal portion of said predetermined path said support surface being positioned with a longitudinal length in an orientation generally transverse to said direction of said predetermined path at an angle of between about 15° and 30° relative to horizontal.

34. The exercise apparatus as claimed in claim 33 wherein when said shuttle is moved to the lower distal portion of the predetermined path, the support surface being positioned with a lateral width in an orientation inclined generally in a forward direction of said apparatus at an angle inclined at between 15 and 50° relative to the horizontal.

35. The exercise apparatus as claimed in claim 33 wherein when said shuttle is moved to the proximal portion of the predetermined path, the support surface being positioned in an orientation inclined at an angle relative to the horizontal at between 0 and ±15°.

36. An ice skating or roller blading exercise apparatus, said apparatus extending generally in a front-to-back direction and comprising, a pair of shuttles, each including an associated pedal having an upper surface for movably supporting a foot of a user standing in a generally forward facing position thereon facing a front of the apparatus, a guide assembly, said guide assembly supporting and limiting each said shuttle in movement along an associated predetermined path, said predetermined paths extending in a substantially mirror arrangement and in a direction away from the other such that the paths do not substantially cross a central plane and extend from a raised upper position and curving downwardly and rearwardly to a lower distal position, and wherein in actuation of said apparatus: said shuttles are each substantially limited in reciprocal movement along said associated predetermined path, and wherein when a first one of said shuttles is positioned in said proximal upper position, the second other shuttle being positionable in the distal position, wherein in the lower distal position, the shuttle positions an upper surface of said pedal in an orientation inclined generally in a forward direction relative to the horizontal at an angle between about 15° and 50°, and wherein in said upper position said shuttle positioning said upper surface of said pedal in an orientation inclined relative to the horizontal at an angle between 0 and 15°.

37. The ice skating apparatus as claimed in claim 36 wherein in said lower distal position said upper surface of said pedal is further inclined in generally transverse to the direction of said predetermined path at an angle of between about 15° and 30° relative to horizontal to reposition the toes of said user's foot thereon in a generally downwardly extending orientation.

38. An exercise apparatus comprising, a pair of pedals, each for movably supporting a foot of a user standing in a generally forward facing position thereon, a guide assembly, said guide assembly supporting and limiting each said pedal in reciprocal movement along an associated predetermined path, said predetermined paths oriented in a substantially mirror arrangement and each extending in a direction away from the other such that the paths do not substantially cross a central plane and extend from a generally adjacent raised proximal upper end portion and curving outwardly and rearwardly, and extending downwardly to a lower distal end portion, a return device for biasing the pedals to an initial starting position spaced towards the proximal end portion, and a tensioning mechanism operable to permit said user to vary resistance to the movement of said pedals in at least one direction along said predetermined path.

39. The exercise apparatus of claim 38 wherein said guide assembly is configured to support an upper surface of said pedal in an orientation inclined at between 15 and 50° when the pedal is located adjacent to the distal end portion.

* * * * *